US007820031B2

(12) United States Patent
D'Alessandro et al.

(10) Patent No.: US 7,820,031 B2
(45) Date of Patent: Oct. 26, 2010

(54) METHOD AND APPARATUS FOR CONVERTING AND REMOVING ORGANOSULFUR AND OTHER OXIDIZABLE COMPOUNDS FROM DISTILLATE FUELS, AND COMPOSITIONS OBTAINED THEREBY

(75) Inventors: Robert N. D'Alessandro, Spanish Fort, AL (US); John Tarabocchia, Parsippany, NJ (US); Jerald Andrew Jones, Frankfurt am Main (DE); Steven E. Bonde, West Richard, WA (US); Stefan Leininger, Langenselbold (DE)

(73) Assignee: Degussa Corporation, Parsippany, NJ (US)

( * ) Notice: Subject to any disclaimer, the term of this patent is extended or adjusted under 35 U.S.C. 154(b) by 810 days.

(21) Appl. No.: 10/576,768

(22) PCT Filed: Oct. 20, 2004

(86) PCT No.: PCT/US2004/034496

§ 371 (c)(1),
(2), (4) Date: May 7, 2007

(87) PCT Pub. No.: WO2005/040308

PCT Pub. Date: May 6, 2005

(65) Prior Publication Data

US 2007/0221538 A1 Sep. 27, 2007

Related U.S. Application Data

(60) Provisional application No. 60/513,210, filed on Oct. 23, 2003.

(51) Int. Cl.
*C10G 17/00* (2006.01)
*C10G 11/00* (2006.01)

(52) U.S. Cl. ..... 208/7; 208/96; 208/196; 208/208 R; 208/219; 208/240; 208/265

(58) Field of Classification Search ..... 208/196, 208/208 R, 96, 219, 240, 265, 7
See application file for complete search history.

(56) References Cited

U.S. PATENT DOCUMENTS

| | | | | |
|---|---|---|---|---|
| 3,919,402 | A | 11/1975 | Guth et al. | |
| 5,004,830 | A * | 4/1991 | Park et al. | 562/413 |
| 5,114,433 | A * | 5/1992 | Dubreux et al. | 44/322 |
| 5,169,516 | A * | 12/1992 | Carr | 208/189 |
| 6,160,193 | A * | 12/2000 | Gore | 585/833 |
| 6,274,785 | B1 | 8/2001 | Gore | |
| 6,596,914 | B2 | 7/2003 | Gore et al. | |
| 7,276,152 | B2 * | 10/2007 | Lin et al. | 208/219 |
| 2002/0035306 | A1 * | 3/2002 | Gore et al. | 585/833 |
| 2006/0211906 | A1 * | 9/2006 | Berezutskiy | 585/820 |

* cited by examiner

*Primary Examiner*—Walter D Griffin
*Assistant Examiner*—Huy-Tram Nguyen
(74) *Attorney, Agent, or Firm*—Oblon, Spivak, McClelland, Maier & Neustadt, L.L.P.

(57) ABSTRACT

The present disclosure is directed to a multi-stage system and a process utilizing said system with the design of reducing the sulfur-content in a liquid comprising hydrocarbons and organosulfur compounds. The process comprising at least one of the following states: (1) an oxidation stage; (2) an extraction state; (3) a raffinate washing stage; (4) a raffinate polishing stage; (5) a solvent recovery stage; (6) a solvent purification stage; and (7) a hydrocarbon recovery stage. The process for removing sulfur-containing hydrocarbons from gas oil, which comprises oxidizing gas oil comprising hydrocarbons and organosulfur compounds to obtain a product gas oil.

16 Claims, 9 Drawing Sheets

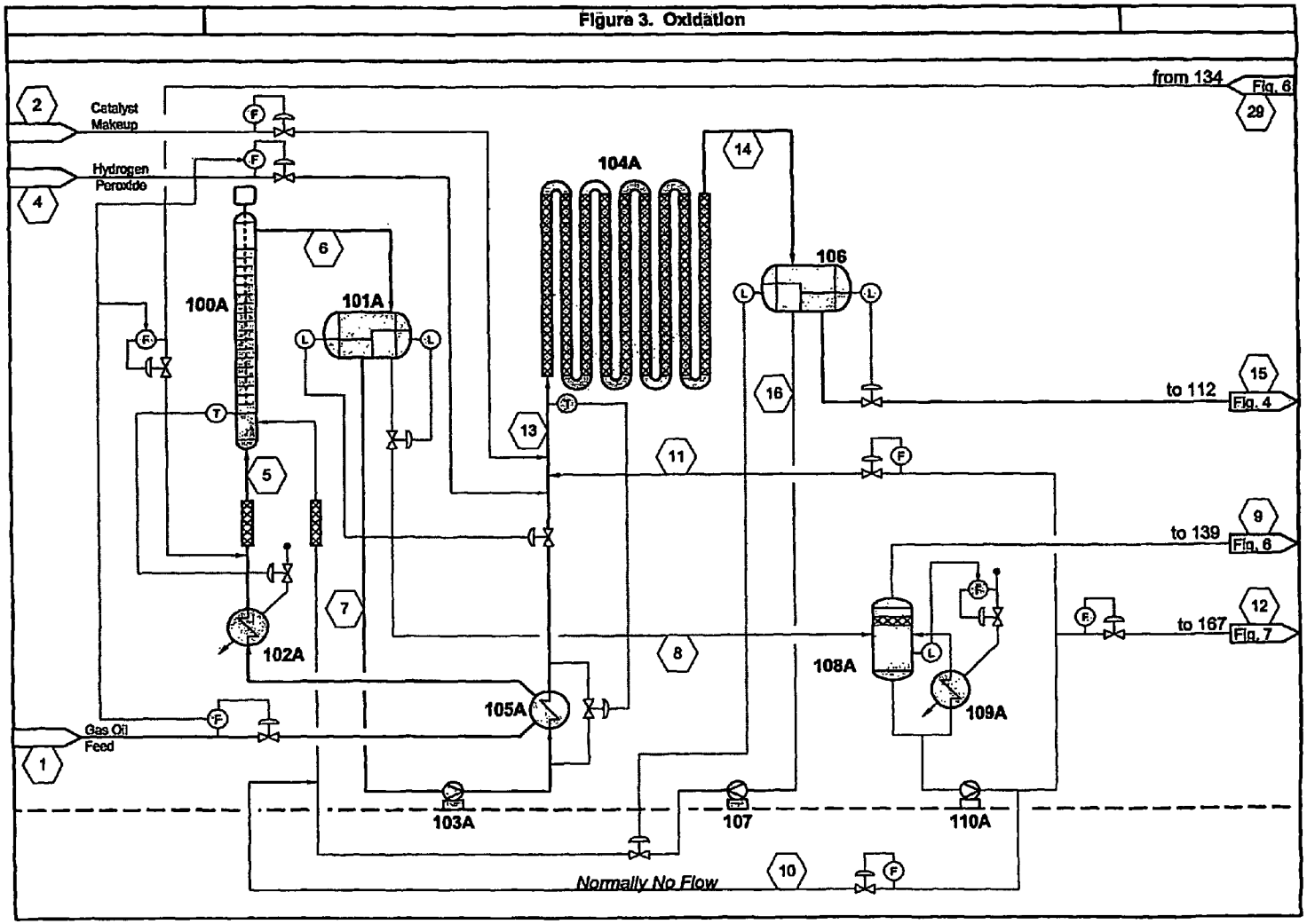
Figure 3. Oxidation

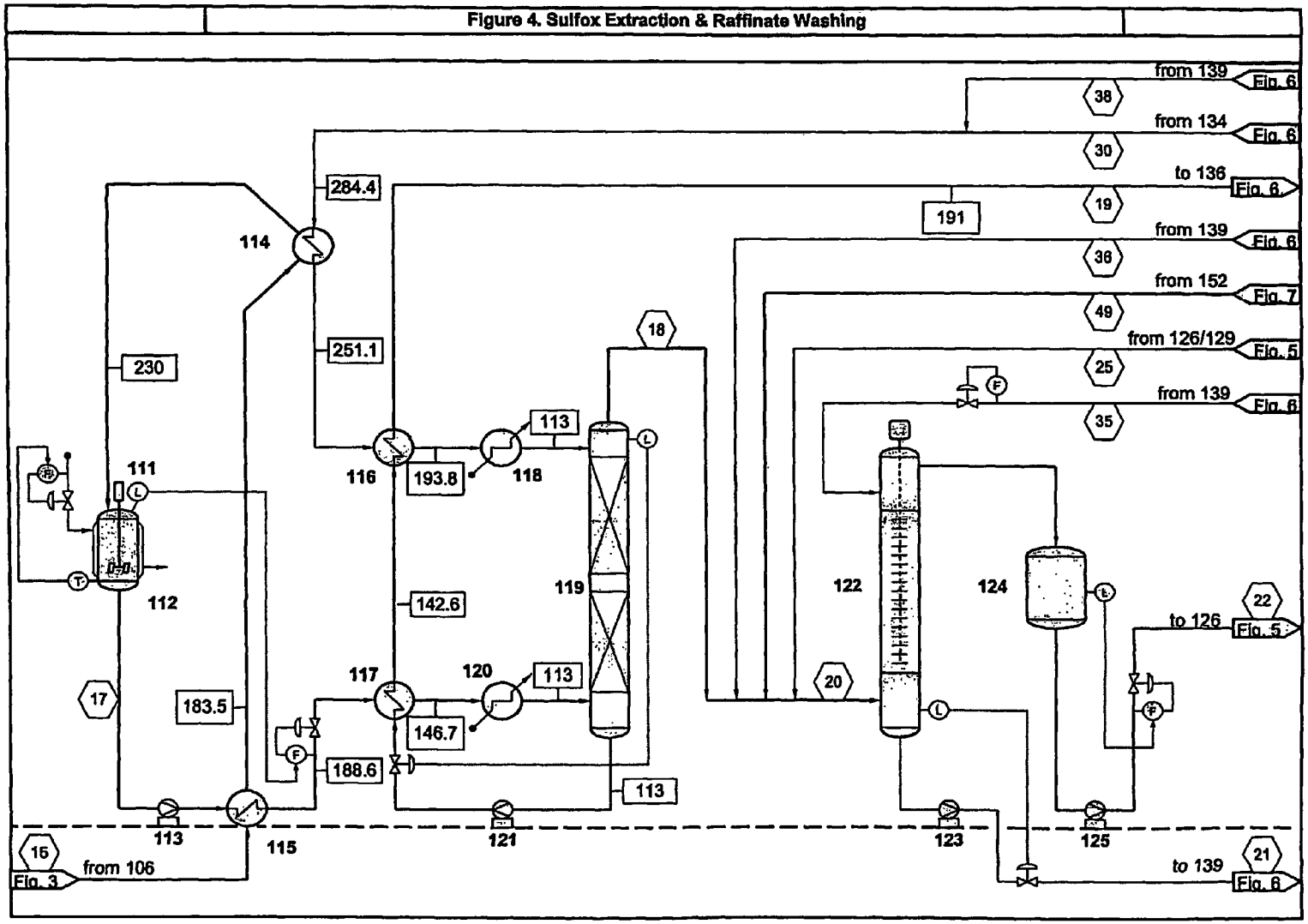
Figure 4. Sulfox Extraction & Raffinate Washing

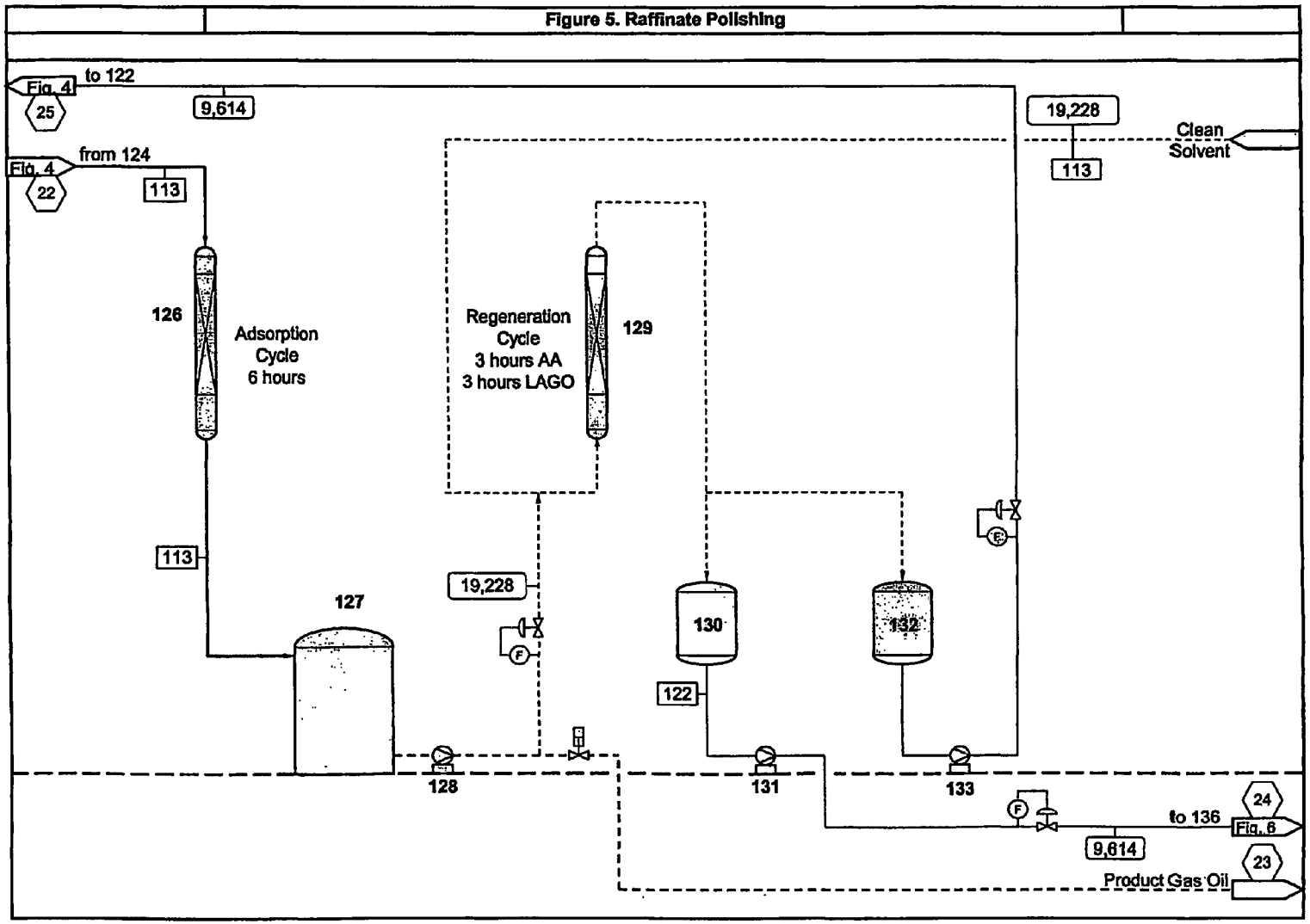
Figure 5. Raffinate Polishing

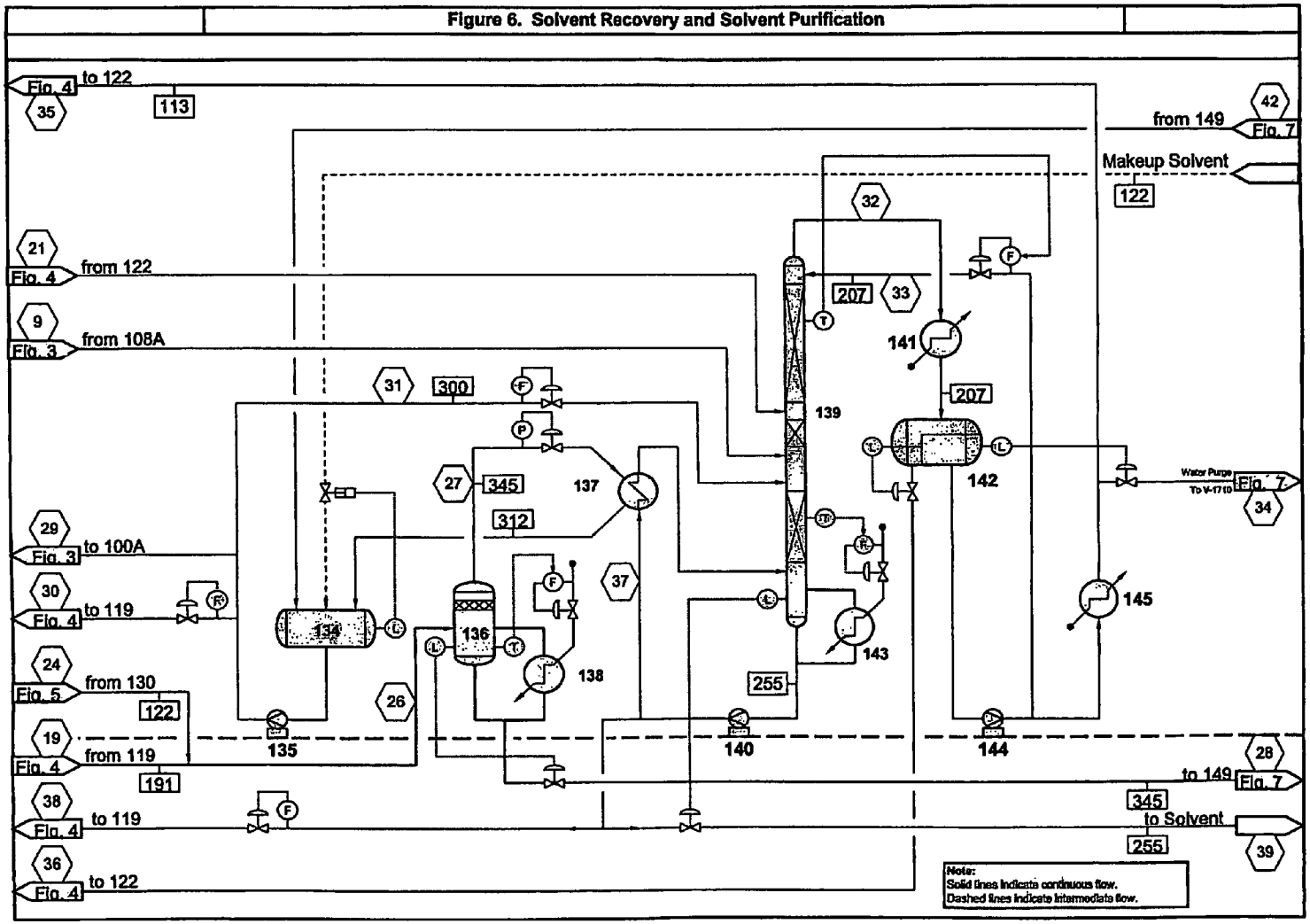
Figure 6. Solvent Recovery and Solvent Purification

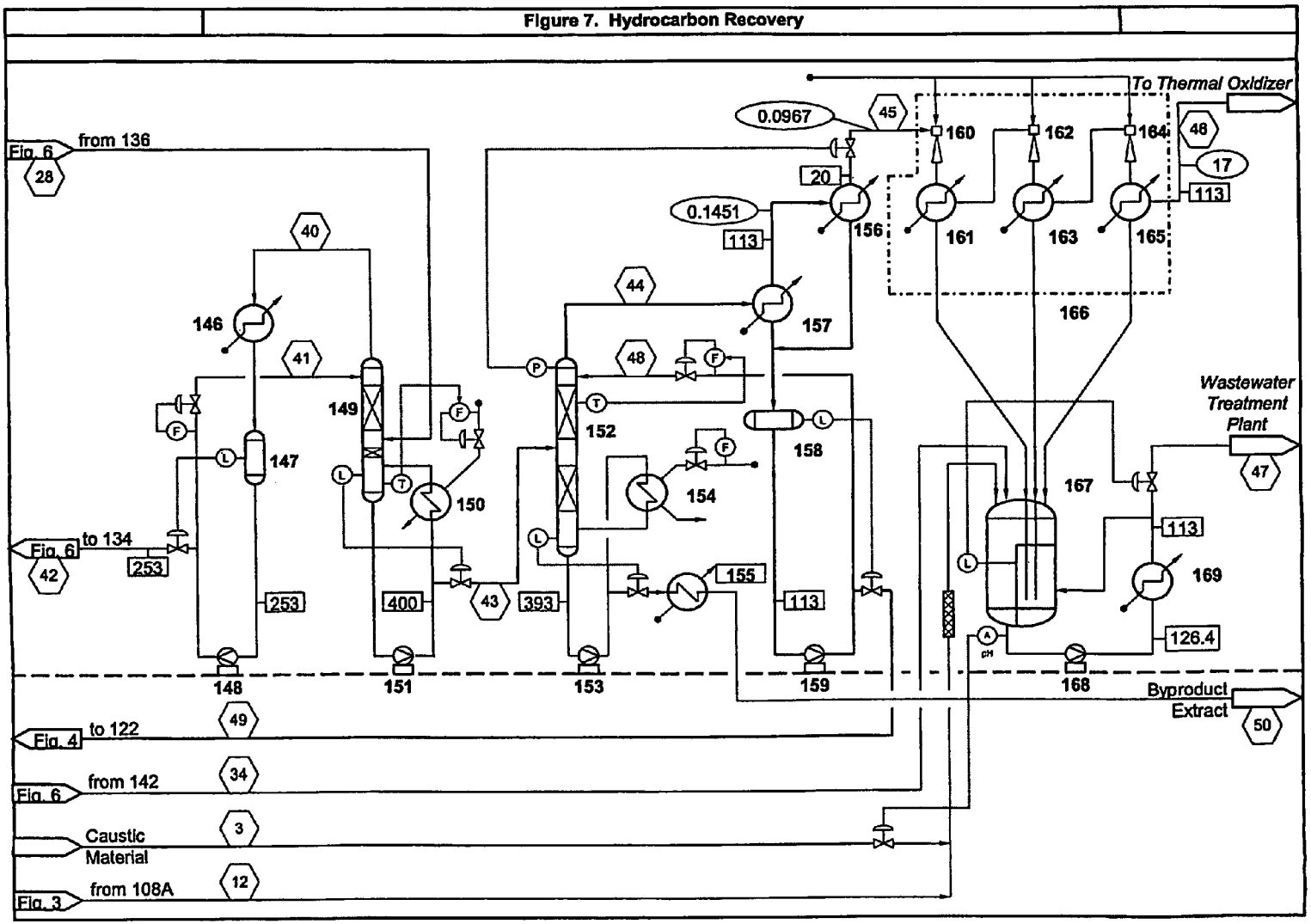
Figure 7. Hydrocarbon Recovery

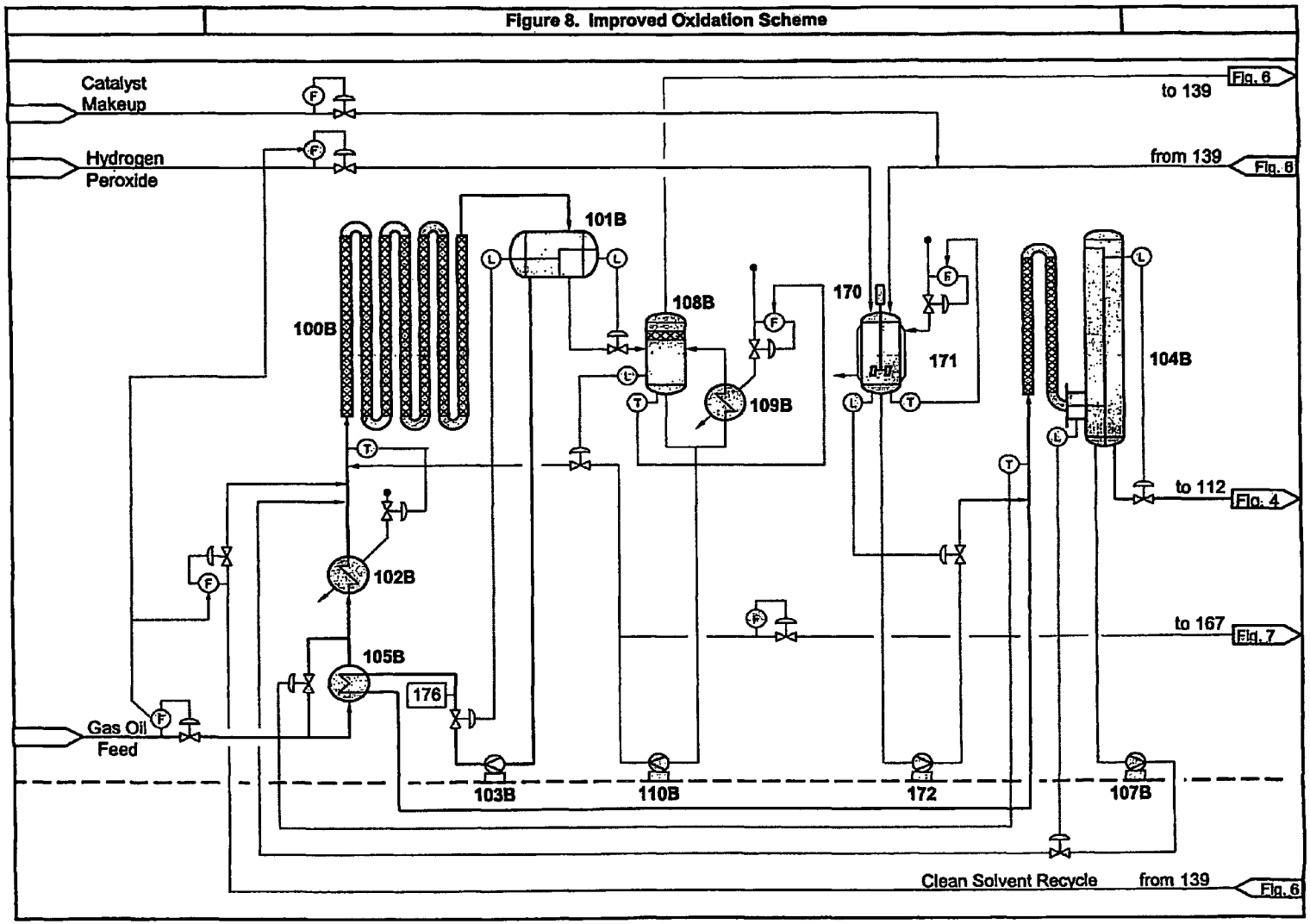
Figure 8. Improved Oxidation Scheme

METHOD AND APPARATUS FOR CONVERTING AND REMOVING ORGANOSULFUR AND OTHER OXIDIZABLE COMPOUNDS FROM DISTILLATE FUELS, AND COMPOSITIONS OBTAINED THEREBY

CROSS-REFERENCE TO RELATED APPLICATIONS

This application claims priority to U.S. Provisional Application No. 60/513,210, filed Oct. 23, 2003; which is entirely incorporated herewith by reference.

STATEMENT REGARDING FEDERALLY SPONSORED RESEARCH

This invention was made with support from the U.S. Government under Cooperative Agreement No. DE-FC26-01BC15281; W(A)-02-003, CH-1087 awarded by the Department of Energy. The U.S. Government has certain rights in this invention.

BACKGROUND OF THE INVENTION

1. Field of the Invention

One aspect of the present invention is directed to a process for reducing the concentration of organosulfur compounds in any hydrocarbon-based fluid and a multi-stage system for conducting the same.

2. Discussion of the Background

Natural fuel stock comprises hydrocarbons and other undesirable components, such as organosulfur compounds. These organosulfur compounds include, but are not limited to, thiophenes, benzothiophenes, dibenzothiophenes, naphthothiophenes naphthobenzothiophenes and their substituted analogs. When combusted, these organosulfur compounds produce undesirable sulfur pollutants that have been generally attributed to societal problems such as respiratory illnesses, acid rain, etc. The sulfur pollutants also poison tail pipe catalytic converters. The catalytic converters are designed to decrease other diesel engine pollutants such as particulate matter, oxides of nitrogen and uncombusted or partially combusted hydrocarbons. Consequently, technologies have been implemented in order to remove organosulfur compounds from natural fuel stock.

At present, hydrodesulfurization (HDS) is the most commonly employed technology used to desulfurize natural fuel stock, said technology being capable of reducing the amount of sulfur to levels of about 300 to 500 ppmw (parts-per-million by weight). However, some of the above-mentioned organosulfur compounds are difficult to desulfize via HDS because they are sterically hindered. This is especially true for the 4 or 6-mono- or 4,6-di-alkyl-substituted dibenzothiophenes. Recently, newer HDS technology has been introduced that is capable of desulfurizing the "difficult to desulfurize" (or hard sulfur) compounds; consequently, this technology affords refineries with the opportunity to reduce the sulfur levels even further. However, this newer HDS technology requires more demanding desulfurization conditions, such as higher temperatures (>650° F. (343° C.)) and pressures (>1000 psig (68.9 bars)), and reduced space velocities. Under these conditions, unnecessary side reactions (e.g., hydrogenation of unsaturated carbon-carbon bonds) become kinetically viable with respect to the sulfur-reduction reaction. Accordingly, large amounts of hydrogen are required for adequate desulfurization, which in turn, results in an overall increase in operating and capital costs. This last matter is due, in part, to the fact that in order to operate at the higher temperatures and pressures, a refinery must equip itself with specialized reactors and equipment. Therefore, this newer HDS technology is somewhat cost and space prohibitive, and thus, may not be an economical alternative for many refineries.

Regardless of the economics associated with this newer HDS technology, all refineries are now facing newly promulgated governmental regulations that limit the sulfur content of fuels. Specifically, the United States Environmental Protection Agency (US EPA) will soon limit sulfur content of "on-road" diesel fuel to 15 ppmw. As noted above, this presents a problem for many refineries because the only available technology capable of producing "on-road" diesel fuel that meets this newly imposed requirement is economically unattractive.

Consequently, the newly introduced stringent regulations coupled with the shortcomings of existing HDS technology have necessitated a search for technologies that may either supplant or complement the existing HDS technology.

Ideally, it would be convenient if the organosulfur compounds could be separated from the hydrocarbon liquid by distillation. Unfortunately, this is not possible, as the physical properties of organosulfur compounds found in hydrocarbon fuels are often very similar to the fuel itself. For example, middle distillate fuels such as atmospheric or vacuum gas oils are produced via distillation. The organosulfur compounds that are contained in these gas oils have the same boiling range as the fuel itself. In fact, organosulfur compounds are found throughout the boiling range of the fuel. Therefore separation of the organosulfur compounds by distillation is not possible. However, an attractive avenue of exploration is one directed to a chemical process whereby organosulfur compounds are converted to altered organosulfur compounds whose physical properties are significantly different than those of the starting organosulfur compounds, and thus, from the overall hydrocarbon liquid.

One possible approach that has recently received attention involves oxidative desulfurization. Oxidative desulfurization operates at mild temperatures (<212° F. (100° C.)) and pressures (<30 psig (2.07 barg)), and several patents have been granted describing oxidative desulfurization processes. Some earlier U.S. Pat. Nos. (2,749,284; 3,341,448; 3,413,307), which are hereby incorporated by reference, describe two common themes of oxidative desulfurization, which include, but are not limited to, reaction of a fuel stock containing organosulfur compounds with an oxidant followed by separation. Other references (U.S. Pat. Nos. 5,753,102; 5,824,207; 5,910,440; 5,958,224; 5,961,820; 6,160,193; 6,171,478; 6,231,755; 6,254,766; 6,274,785; 6,277,271; 6,338,794; 6,402,940; 6,402,939; and 6,406,616; and US Statutory Invention Registration H1986), which are hereby incorporated by reference, encompass the earlier developed themes of oxidization of unwanted organosulfur compounds present in hydrocarbon liquids followed by separation of the oxidized organosulfur compounds from the desired hydrocarbon liquid. On the whole, these references represent the conventional processes for reducing unwanted organosulfur compounds from fuel stocks; all of which involve an oxidation reaction, wherein organosulfur compounds are converted to their respective sulfoxides and sulfones, followed by one or more separation steps. The separation steps include, but are not limited to, extraction and adsorption (either alone or in combination).

The themes associated with oxidative desulfurization contained in many of these references shows that when organosulfur compounds are oxidized, the resultant oxidized organosulfur compounds have significantly different physical properties that provide an opportunity for separating the oxidized organosulfur compounds from the hydrocarbon liquid. For example, when the sulfur-containing compounds contain thiophenic sulfur, the oxidized organosulfur compounds comprise corresponding thiophenic sulfoxides or sulfones whose physical properties (e.g., polarity and volatility) are significantly different than those of the unoxidized thiophenic compounds. These differences in the physical properties enable the separation of oxidized organosulfur compounds from the hydrocarbon fuel. Separation techniques can rely on many physical properties, and the two mentioned properties (e.g., polarity and volatility) are not exhaustive but are mentioned for illustrative purposes.

Even though the above-identified references are directed to the problem of removing unwanted organosulfur compounds from fuel stocks, these references do not adequately describe a process that may be adapted for use in middle distillate fuel stocks that contain about 5000 ppmw or more of organosulfur compounds. The reason for this lies in the overall conversion of the oxidation reaction. For example, in order to satisfy the US EPA standard of 15 ppmw, a process that includes the oxidation reaction must be able to consistently operate at a reaction conversion of no lower than about 99.4%, when the organosulfur content is about 5000 ppmw. Ideally, it is desirable to develop a substantially quantitative oxidative process, in order to remove substantially all of the sulfur-containing hydrocarbons from a middle distillate fuel stock.

Accordingly, a problem to be solved by the present invention relates to a process wherein the conversion of unoxidized organosulfur compounds to oxidized organosulfur compounds occurs substantially quantitatively. Substantially quantitative oxidation simultaneously allows for efficient separation and removal of organosulfur compounds and further recovery of hydrocarbon fuel.

This problem becomes apparent when one considers that efficiency of the above-mentioned separation processes (i.e., extraction and adsorption) is dependent upon the overall oxidation conversion process. For example, when processing fuels with approximately 5000-ppmw sulfur content, it has been found that it is advantageous to remove most of the sulfur compounds utilizing a liquid-liquid extraction process. However, an extraction step that involves high sulfur removal leads to high solvent to feed ratios. While recovery of the solvent extract after the liquid-liquid extraction does not pose major difficulties, the resultant extract is not only rich in oxidized organosulfur compounds, but also contains sulfur-free fuel components, particularly aromatic compounds. The quantity of fuel lost via the liquid-liquid extraction step may range from 20 to 35 wt %, which leads to another problem to be solved. That is, liquid-liquid extraction of an oxidized fuel stock leads to a concomitant loss of fuel. If the overall conversion of the oxidation is not substantially quantitative, then it becomes difficult to recover lost fuel. While it may be possible to further process the solvent extract stream in other refinery units or to burn the solvent extract stream for its energy value or use the solvent extract stream as an asphalt modifier, the inventors found that downgrading the solvent extract stream, i.e., as feed to another refinery processing unit, is not economically advantageous.

Accordingly, the present invention provides a solution aimed at overcoming these difficulties, by in turn providing a new process that is attractive in that it overcomes a problem of fuel loss upon liquid-liquid extraction. It is noted that minimized fuel loss is made possible by achieving substantially quantitative oxidative conversion during the oxidation stage of the overall process. Consequently, the solvent extract that contains fuel may be subjected to additional process steps that afford the recovery of fuel via distillation. This provides a higher overall recovered yield of fuel that has heretofore never been accomplished, as other oxidative processes cannot simultaneously achieve the low sulfur fuel yields made possible by the present invention.

In addition to the advantages inhered by the substantially quantitative oxidative conversion process, the present invention inheres additional advantages over pre-extraction type processes, such as those described, for example, by Gore in U.S. Pat. Nos. 6,160,193 and 6,274,785. For example, these advantages include: (1) Favors fuel recovery over minimizing oxidant consumption; (2) Minimizes the circulation of extraction solvent; (3) Eliminates the need for an extract wash step; and (4) Minimizes corrosive catalytic acids in downstream lines and equipment.

SUMMARY OF THE INVENTION

Accordingly, a solution to the problems presented by the above-identified government mandate is found in a process which comprises contacting a first liquid comprising at least one hydrocarbon compound with a first oxidant in a first reactor and contacting a second liquid comprising at least one hydrocarbon obtained from the first reactor with a second oxidant in a second reactor.

In this process the first liquid may be any hydrocarbon-based fluid. Both oxidants comprise a percarboxylic acid that is obtained by reacting carboxylic acid with hydrogen peroxide. The second liquid is obtained directly or indirectly from the first reactor. For the purpose of this disclosure, when the second liquid is obtained directly from the first reactor, the second liquid comprises a first reactor effluent (or first effluent). When the second liquid is obtained indirectly from the first reactor, the second liquid is obtained by separating the first effluent into two phases in a first vessel, i.e., a first light phase comprising at least one hydrocarbon compound and a first heavy phase comprising a polar solvent; wherein said polar solvent comprises a carboxylic acid.

As noted above, the first liquid may be any hydrocarbon-based fluid, which may be a crude gas oil, a distillate of crude oil, a middle distillate comprising hydrocarbons having boiling points that range from 65° C. to 385° C., or a crude gas oil obtained by a hydrodesulfurization process. An attractive feature of the disclosed invention is that the process may be employed either prior or subsequent to an HDS process.

A key feature of said process is that the overall oxidation is achieved by employing a counter-current oxidation scheme. That is, the first liquid that makes contact with the first oxidant has a higher unoxidized sulfur content than the second liquid that makes contact with the second oxidant; which means that the total oxidant concentration in the first oxidant may equal to or lower than the total oxidant concentration in the second oxidant. Stated in another way, the ratio of the total oxidant concentration in the first oxidant, $[Ox_{t,1}]$, to the total oxidant concentration in the second oxidant, $[Ox_{t,2}]$, is less than or equal to 1, i.e., $[Ox_{t,1}]/[Ox_{t,2}] \leqq 1$. In the practice of the invention, the ratio $[Ox_{t,1}]/[Ox_{t,2}]$ may range from 0.0001 to 1, preferably from 0.001 to 1, more preferably from 0.01 to 1, and most preferably from 0.1 to 1.

Not to be limited by theory, but application of the counter-current oxidation scheme may be explained in terms of the kinetics of oxidation. When the unoxidized sulfur content is high, then oxidant concentration need not be too high, in order to achieve an acceptable conversion rate. However, when the unoxidized sulfur content is lower, then the oxidant concentration becomes more relevant. Accordingly, the total oxidant concentration in the second oxidant will be higher than that of the total oxidant concentration in the first oxidant, as the unoxidized sulfur content of the second liquid is lower than that of the first liquid. These and other aspects will be explained in more detail below.

While the U.S. EPA mandate is concerned with decreasing the concentration of organosulfur compound in "on-road" diesel fuel, it is conceivable that the disclosed process would be applicable for decreasing the concentration of organonitrogen compounds that are present in any hydrocarbon-based fluid. Moreover, an attractive feature of the present invention is that it is capable of improving the storage stability of a product gas oil obtained by the disclosed process.

Additionally, another aspect of the present invention is achieved by a multi-stage system capable of reducing organosulfur compounds in a liquid, comprising an oxidation stage; an extraction stage; a raffinate washing stage; a raffinate polishing stage; a solvent recovery stage; a solvent purification stage; and a hydrocarbon recovery stage. A more detailed description of the process appears below.

BRIEF DESCRIPTION OF DRAWINGS

FIG. 3 is a specific process flow diagram of the Oxidation portion of the disclosed process.

FIG. 4 is a specific process flow diagram of the Sulfox Extraction and Raffinate Washing portion of the disclosed process.

FIG. 5 is a specific process flow diagram of the Raffinate Polishing portion of the disclosed process.

FIG. 6 is a specific process flow diagram of the Solvent Recovery and Solvent Purification portion of the disclosed process.

FIG. 7 is a specific process flow diagram of the Hydrocarbon Recovery portion of the disclosed process.

FIG. 8 is a specific process flow diagram of an Improved Oxidation portion of the disclosed process.

DETAILED DESCRIPTION OF THE INVENTION

Figure 1A:
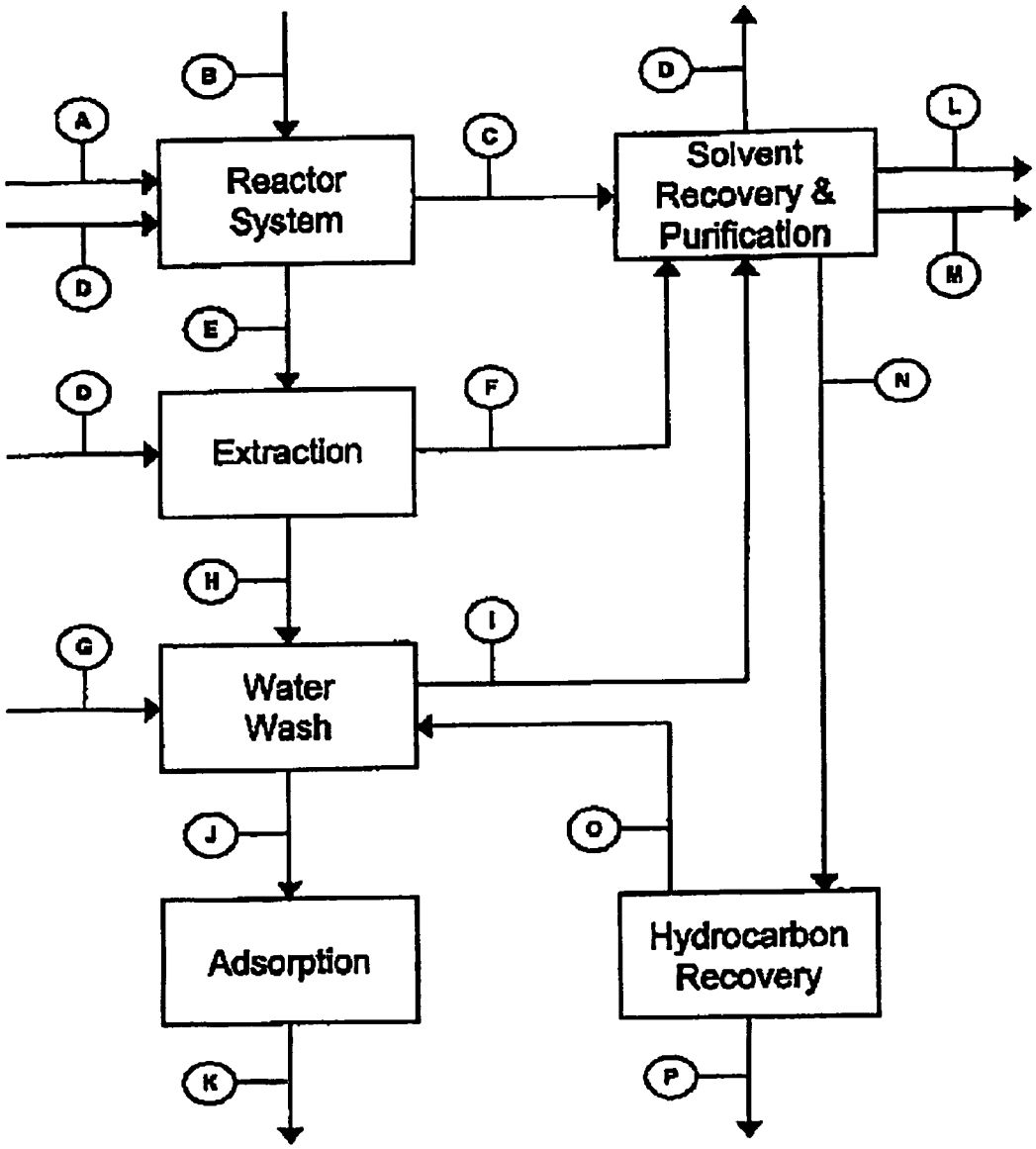
FIG. 1A is generalized block flow diagram representing the disclosed process.

A schematic block flow diagram showing one preferred embodiment of the invention is given in FIG. 1A, attached, and described in more detail below.

The invention process is particularly suitable to treat middle distillate fuels that contain a broad array of sulfur compounds. The sulfur compounds may be present in percent level concentrations. The oxidant is a peroxycarboxylic acid. The inventors found that the carboxylic acid used to form the peroxycarboxylic acid is optimally used as the solvent. If a different solvent is chosen, then two separate "Solvent Recovery and Purification" steps and two separate "Hydrocarbon Recovery" steps would be needed.

1. Reactor System

The first step in the process is to combine the oxidant solution in Stream A, the high sulfur feed in Stream B and the carboxylic acid or an aqueous solution of the carboxylic acid in Stream D1 in the "Reactor System". In this step, the organosulfur compounds in the fuel are converted to sulfoxides or sulfones. Excess water from the reactor system, Stream C, is directed to the "Solvent Recovery and Purification" step. The light phase leaves the "Reactor System" via Stream E. If the reactor conditions are chosen so that only one phase forms then the entire contents of the "Reactor System" leaves via Stream E.

2. Extraction

The next step in the process is the "Extraction". The Extraction may be carried out in any suitable liquid/liquid-contacting device. The fuel containing oxidized sulfur compounds in Stream E is contacted with the solvent in Stream D2. The more polar sulfoxides and sulfones leave the "Extraction" step together with the solvent in Stream F. The raffinate leaves the "Extraction" step via Stream H. Stream H comprises fuel with less sulfur compounds and some solvent.

3. Water Wash

The next step in the process is a "Water Wash." The purpose of this step is to remove residual solvent from the fuel. This step is accomplished by contacting the fuel with water in any suitable liquid/liquid-contacting device. Fuel enters this step via Stream H and Stream O. Water enters via Stream G. The heavy phase leaves via Stream I. Stream I comprises water and solvent. Stream I is directed to the "Solvent Recovery and Purification" step. The fuel, substantially free of solvent, leaves via Stream J.

4. Adsorption

The next step in the process is "Adsorption". This step may or may not be needed depending on the sulfur concentration remaining after extraction. The purpose of the "Adsorption" step is to remove the last traces of sulfur from the fuel. The fuel enters via Stream J and exits this step via Stream K. A number of solids have been found to be suitable for this step of the process that include, but are not limited to, refiner's clay. The regeneration of the adsorbent may be carried out in several ways. These methods involve the use of a carrier fluid and changes in temperature, pressure, or concentration. These changes alter the equilibrium, and favor desorption of the adsorbed substance. If the extraction solvent is used for the regeneration, then the resultant stream may be directed to the "Solvent Recovery and Purification" step.

Bed regeneration may be accomplished using the extract solvent and subsequent recycling to the front end of the process.

5. Solvent Recovery and Purification

The next step in the process is "Solvent Recovery and Purification". The purpose of this step is to recover and re-use the carboxylic acid that is used as the solvent and the precursor for the peroxycarboxylic acid. The additional capital and operating expense of this step is less than the cost of purchasing fresh solvent. The "Solvent Recovery and Purification" step includes various unit operations, such as distillation and flash evaporation, designed to separate solvent from water or solvent from extract.

Solvent enters this step primarily via Stream F, Stream C, if present, and possibly via a regeneration step associated with the "Adsorption" step. Recovered solvent leaves via Stream D and is directed to the unit operations requiring solvent. Fresh solvent may be added to this stream or at other convenient points in the process to make up for losses.

Water with some solvent enters the "Solvent Recovery and Purification" step via Stream I. Water enters the process in Stream A and Stream G. Some water is also formed during the transformation of the carboxylic acid to the peroxycarboxylic acid using hydrogen peroxide. For example acetic acid, when reacted with hydrogen peroxide, is transformed to peracetic acid (PAA) with the concomitant formation of water.

Hydrogen peroxide is commercially available as aqueous solutions. For these reasons water must be purged from the system via Stream M to prevent an accumulation of water. Some water may be recycled via Stream L. A small hydrocarbon phase may be generated during solvent recovery and purification. This stream may be processed through the "Water Wash" to improve yield.

6. Hydrocarbon Recovery

The next step of the process is "Hydrocarbon Recovery". Material is fed to this step via Stream N. Stream N is the extract (Stream F) with the solvent removed. Stream N contains the oxidized organosulfur compounds (sulfoxides and sulfones) and fuel components, and residual acetic acid. The fuel components are primarily the more polar aromatic compounds that boil in the diesel range. The "Hydrocarbon Recovery" step utilizes the volatility difference between the sulfoxides and sulfones and the aromatic fuel compounds. The inventors found that the boiling points of the oxidized sulfur compounds are beyond most of the compounds normally found in diesel. Distillation, vacuum distillation in particular, is a suitable unit operation for separating the fuel components from the oxidized sulfur compounds. The recovered fuel components are returned to the process via Stream O. The final extract leaves the process via Stream P.

One advantage of the present invention is realized by taking advantage of many of the physical property differences that are imparted to the organosulfur compounds once they are converted to their respective sulfoxides or sulfones. The instant invention is economically favorable for the removal of undesired components and maximizes the fuel yield across the process.

As noted above, the disclosed reactor process is made surprisingly superior, and consequently, economically feasible by attaining significant hydrocarbon recovery via distillation. This is especially true if the oxidation step is capable of substantially complete conversion of the organosulfur compounds to their respective polar organosulfur compounds. In their unoxidized form, the organosulfur compounds have the same boiling range as the rest of the hydrocarbons found in the distillate stream. If left unoxidized, these organosulfur compounds distill simultaneously with the hydrocarbons rendering distillation ineffective as a method to minimize yield loss. Once oxidized, the boiling points of these compounds are shifted significantly higher. This increase in the boiling points allows distillation to become a feasible method of hydrocarbon recovery.

As noted above, the multi-stage system and process is based on a middle distillate considered as Light Atmospheric Gas Oil (LAGO). This middle distillate comprises-aliphatic, cycloaliphatic (or naphthenic), olefinic, aromatic, and heteroatom-containing derivatives thereof. For the purpose of this disclosure, the middle distillate is that portion of crude oil that distills from about 150° F. (65.6° C.) to about 800° F. (385° C.). Furthermore, in addition to "on-road" diesel, it believed that the disclose process is capable of producing "off-road" and "marine" diesel having reduced sulfur content. Additionally, it is believed that the process disclosed herein is capable of reducing sulfur content in the following feedstocks: Middle Distillates; Gas Oils; Atmospheric Gas Oils; Light Atmospheric Gas Oils; Distillate Fuel Oils; Kerosine; Diesel Fuel; Jet Fuel; Home Heating Oil; Solvents; Hydrotreated Middle Distillates; Hydrotreated Gas Oils; Hydrotreated Atmospheric Gas Oils; Hydrotreated Light Atmospheric Gas Oils; Kerosine (ASTM D-3699); Kerosine (No. 1-K) (ASTM D-3699); Kerosine (No. 2-K) (ASTM D-3699); Civil Aviation Turbine Fuels (ASTM D-1655); Jet A-1 Civil Aviation Turbine Fuel (ASTM D-1655); Jet A Civil Aviation Turbine Fuel (ASTM D-1655); Military Aviation Turbine Fuels; JP-5 Military Aviation Turbine Fuel; JP-8 Military Aviation Turbine Fuel; Diesel Fuel Oils (ASTM D-975); Diesel Fuel Oil Grade No. 1-D S500 (ASTM D-975); Diesel Fuel Oil Grade No. 1-D S5000 (ASTM D-975); Diesel Fuel Oil Grade No. 2-D S500 (ASTM D-975); Diesel Fuel Oil Grade No. 2-D S5000 (ASTM D-975); Diesel Fuel Oil Grade No. 4-D (ASTM D-975); Fuel Oils (ASTM D-396); Grade 1 Fuel Oil (ASTM D-396); Grade 1 Low Sulfur Fuel Oil (ASTM D-396); Grade 2 Fuel Oil (ASTM D-396); Grade 2 Low Sulfur Fuel Oil (ASTM D-396); Grade 4 Light Fuel Oil (ASTM D-396); Grade 4 Fuel Oil (ASTM D-396); Marine Distillate Fuels; Grade DMX Marine Distillate Fuel; Grade DMA Marine Distillate Fuel; Grade DMB Marine Distillate Fuel; Grade DMC Marine Distillate Fuel.

In essence, the reaction chemistry changes the physical properties (i.e., polarity and volatility) of the organosulfur compounds contained in LAGO. The process then takes advantage of these changes in the physical properties to separate the oxidized organosulfur compounds from the balance of the hydrocarbon fuel.

As highlighted below, the disclosed process is illustrated based on a simulated gas oil feed that comprises about 5100 ppm of sulfur by weight. However, it is possible to apply the same process to other middle distillate feeds with a lower or higher sulfur content, for example, from 5 to 100,000 ppm, which includes 5; 10; 50; 100; 500; 1000; 2000; 3000; 4000; 5000; 6000; 7000; 8000; 9000; 10,000; 20,000; 50,000; 75,000; 100,000; ppm by weight and any combination thereof. In the case of hydrotreated middle distillates (i.e., HDS-treated middle distillates), the invention is expected to perform both technically and economically better than the specific example described herein. The process is also suitable for treating other middle distillates, since the overall concept clearly applies.

In the case of hydrotreated middle distillates, where the overall sulfur content is typically below 500 ppmw, the multi-stage process is expected to perform both technically and economically better than the specific example described herein. Hydrotreated middle distillates typically lack the lower molecular weight thiophenic compounds and are rich in higher molecular weight highly substituted dibenzothiophenes (i.e., the hard sulfur compounds). As mentioned previously, these higher molecular weight highly substituted dibenzothiophenes are easier to oxidize via the disclosed oxidation process with respect to a HDS process. For this reason, as well as the lower total sulfur content of the feed, an overall decrease in the consumption of oxidant is expected. In addition, it may be possible to achieve total oxidation with a simpler oxidation system. For example, employing a hydrocarbon-based liquid obtained by an HDS process in which the organosulfur concentration has been substantially reduced. It may be possible to achieve total oxidation in a single reactor, wherein said reactor is a plug-flow reactor or series of continuous stirred-reactors. Once oxidized, these higher molecular weight highly substituted dibenzothiophenes will have very high boiling points. Therefore, the ease of hydrocarbon recovery should increase, thereby allowing an improvement in the overall process yield. Potential yields of greater than 98 percent may be possible, which is more than adequate when one considers that the starting sulfur content is about 500 ppmw.

Figure 1B:
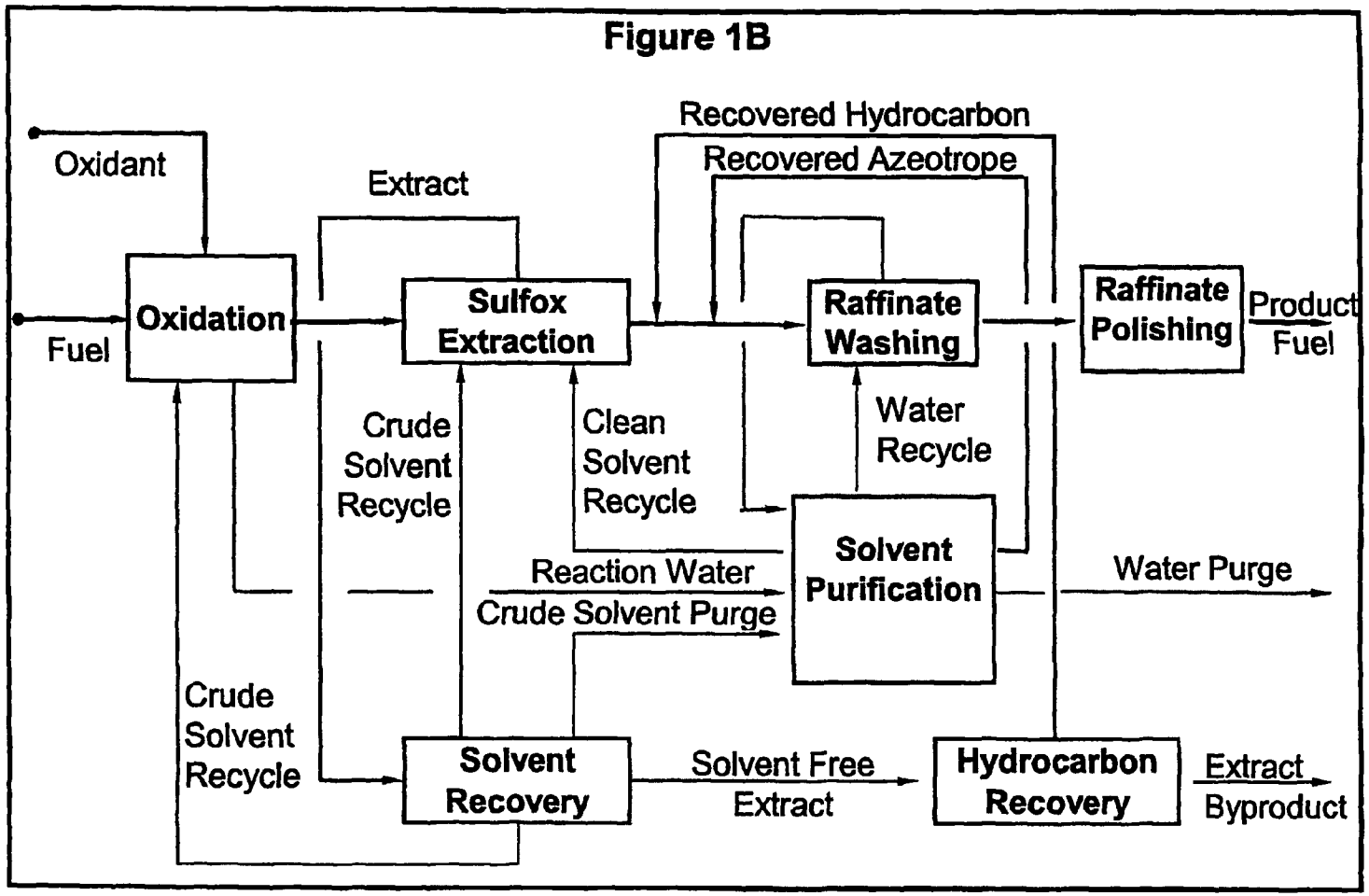
FIG. 1B is a block flow diagram representing the seven major unit operations of the disclosed reactor and process.

A better understanding of the overall disclosed process may be gleaned upon reading the following text in view of FIG. 1B. A more detailed discussion of a preferred embodiment of the disclosed invention is presented below.

It should be apparent upon inspection of FIG. 1B that there are, preferably, seven major unit operations in the invention process: (1) Oxidation, (2) Sulfox Extraction, (3) Raffinate Washing, (4) Raffinate Polishing, (5) Solvent Flash/Solvent Recovery, (6) Solvent Purification, and (7) Hydrocarbon Recovery.

In the Oxidation System, the thiophenic compounds in fuel (gas oil) are ultimately oxidized to sulfones. The oxidation is accomplished with hydrogen peroxide in the presence of recycled carboxylic acid (CA). It should be clear that the requisite overall molar conversion of the oxidation process is, of course, dependent upon the amount of unoxidized organosulfur compounds in the feed stock. However, the overall molar conversion of the unoxidized organosulfur to the oxidized organosulfur compounds is about 99.4 percent, preferably 99.6 percent, more preferably 99.7 percent, and most preferably 99.8 percent; wherein for every mole of sulfur present in the feed, about 2.5 to 5.0 moles of oxidant, preferably 3 moles of oxidant are required. This amount of oxidant is 50 percent more than the stoichiometric requirement necessary for complete conversion to the sulfone. The water formed by the reaction of acetic acid and hydrogen peroxide and the water that enters the oxidation system with the hydrogen peroxide are separated from the oxidized gas oil and fed to Solvent Purification for recovery of CA and purging of reaction water. The oxidized gas oil that is now saturated with CA is fed to the Sulfox Extraction System.

The solution chemistry that may occur in the Oxidation portion of the reactor process is outlined as follows.

There are many organosulfur compounds in straight run LAGO. Typically, these organosulfur compounds have a fairly high molecular weight and belong to a general class of compounds called thiophenics. In most cases, these compounds are benzothiophene, naphthothiophene, dibenzothiophene, naphthobenzothiophene, and their substituted homologues. Their respective molecular structures are shown below.

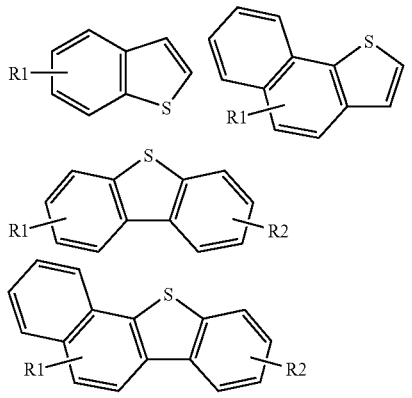

These organosulfur compounds are oxidized to sulfoxides and subsequently sulfones via reactions with active oxygen in the form of percarboxlic acid. In the invention process, the reactions are typically conducted at moderate temperatures (50° F. (10° C.) to 250° F. (121° C.), which includes 50, 75, 100, 115, 120, 122, 125, 135, 145, 155, 165, 175, 185, 195, 200, 205, 210, 212, 214, 220, 250° F., and any combination thereof) and at or about atmospheric pressure. In this temperature range, the reaction mixture preferably includes two liquid phases. The oxidation reactions could be conducted in a single-phase mixture by utilizing a higher temperature.

In the present application, the R, $R^1$ and $R^2$ groups may each independently be any linear or branched, cyclic or aliphatic, substituted or unsubstituted $C_1$-$C_{20}$ alkyl group, substituted or unsubstituted $C_7$-$C_{30}$ aryl group, $C_7$-$C_{30}$ arylalkyl group, and combinations thereof. This includes those having 1, 2, 3, 4, 5, 6, 7, 8, 9, 10, 11, 12, 13, 14, 15, 16, 17, 18, 19, 20, 21, 22, 23, 24, 25, 26, 27, 28, 29, and 30 carbons, and any combination thereof.

The heavy phase contains carboxylic acid, hydrogen peroxide, percarboxylic acid, water, sulfuric acid, soluble hydrocarbons, and soluble thiophenic compounds. The dominant species in the heavy phase is the carboxylic acid, which is a carboxylic acid is represented by the formula RCOOH, wherein R is an radical selected from the group consisting of H, methyl, ethyl, n-propyl, i-propyl, n-butyl, i-butyl, s-butyl, n-pentyl, i-pentyl, and s-pentyl. Though not to be limiting, the carboxylic acid that may be employed is selected from the group consisting of formic acid, acetic acid, propionic acid, butyric acid, pentanoic acid, hexanoic acid, and mixtures thereof; preferably the carboxylic acid is selected from the group consisting of formic acid, acetic acid, propionic acid, and mixtures thereof; and more preferably the carboxylic acid is selected from the group consisting of formic acid, acetic acid, and mixtures thereof; and most preferably the carboxylic acid is acetic acid. The formation of PCA primarily occurs in the heavy phase. Once formed, a portion of the PCA migrates to the light phase.

The light phase preferably includes mostly hydrocarbons with a significant amount of carboxylic acid, and relatively small amount of percarboxylic acid, hydrogen peroxide, water and sulfuric acid.

The oxidation of thiophenic compounds to sulfones probably occurs in both the light and heavy phases. The formation of sulfones may be very fast in the heavy phase since the concentration of PCA may be relatively high. In the light phase, oxidation rates are slower, especially as the concentration of unoxidized sulfur-containing compounds approaches zero.

The reaction paths are quite complex involving both reaction kinetics and mass transfer effects. Intimate contact between the two liquid phases in the reaction mixture is preferred for obtaining a sufficient rate of transfer of the PCA between the two phases.

Percarboxylic Acid (PCA) Formation (Equation 1)

Percarboxylic acid (PCA) is formed via an equilibrium reaction between hydrogen peroxide and carboxylic acid (CA); wherein R is selected from the group consisting of H, methyl, ethyl, n-propyl, i-propyl, n-butyl, i-butyl, s-butyl, n-pentyl, i-pentyl, and s-pentyl.

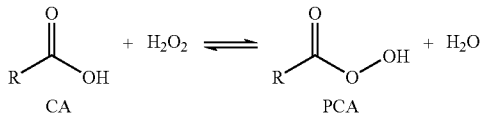

(1)

In addition to PCA, water is formed as a byproduct. The reaction is slightly exothermic liberating approximately 348 calories (1.46 kJ) per g-mole of PCA formed.

At room temperature, without the aid of a catalyst, the reaction may be extremely slow and equilibrium concentration may take many hours to achieve. Higher temperatures can be utilized to accelerate the reaction rate within limits. Above 194° F. (90° C.), decomposition of both the hydrogen peroxide and the resulting PCA begins to become significant.

Significant increases in reaction rate without significant losses due to decomposition are best achieved by using a catalyst. Typically, a strong acid catalyst may be utilized. In the invention process, sulfuric acid may be used to catalyze the formation of PCA.

At the reaction temperatures, hydrogen peroxide, CA, and sulfuric acid concentrations used in the invention process, near reaction equilibrium conditions are achieved within 2 to 5 minutes and approximately 90% of the hydrogen peroxide has been converted to PCA. The equilibrium constant for the reaction is approximately 2.2 and may be a weak function of the reaction temperature. A large excess of CA may be utilized to favor the product side of the equilibrium reaction.

Sulfoxide Formation (Equation 2)

Oxidation of the thiophenic compounds occurs in two reaction steps. In the first step, thiophenic compounds react with PCA to form a sulfoxide. CA is generated as a byproduct. This reaction is irreversible and highly exothermic. At relatively high thiophenic concentrations, this reaction is very fast. The reaction shown below depicts the oxidation of a generic dibenzothiophene. Similar reaction stoichiometry occurs for benzothiophenes, naphthothiophenes, and naphthobenzothiophenes.

(2)

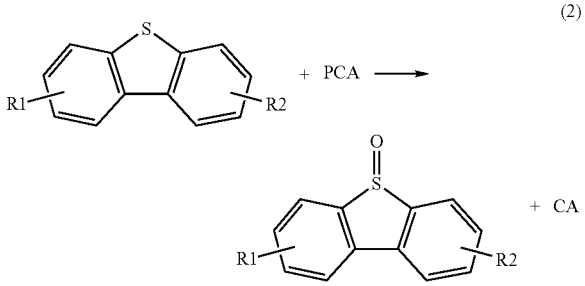

Sulfone Formation (Equation 3)

In the presence of PCA, the sulfoxide, once formed, may be quickly oxidized to the sulfone (Eqn. 3). As in the formation of the sulfoxide, the formation of the sulfone also results in the production of CA. This reaction is also irreversible, highly exothermic, and very fast. The reaction shown below depicts the oxidation of a generic dibenzothiophene sulfoxide. Similar reaction stoichiometry occurs for benzothiophene sulfoxides, naphthothiophene sulfoxides, and naphthobenzothiophene sulfoxides.

(3)

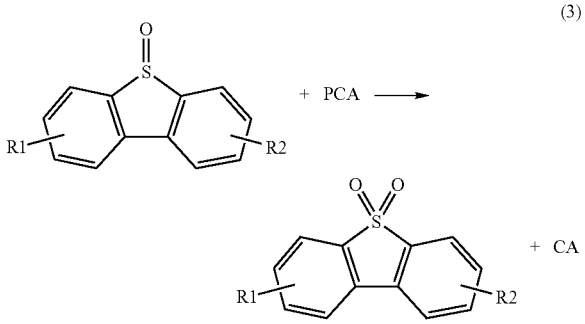

The literature on the oxidation of thiophenic compounds utilizing PCA indicates that the formation of the sulfoxide is the rate-limiting step when considering the oxidation only. For dibenzothiophene, the relative difference in reaction rate of thiophenics with respect to sulfoxide is approximately 1.4. Namely, the oxidation rate of dibenzothiophene sulfoxide to dibenzothiophene sulfone is 40% greater than the oxidation rate of dibenzothiophene to dibenzothiophene sulfoxide. Therefore, once formed, the sulfoxide is quickly oxidized to the sulfone.

In the oxidation of the thiophenic compounds contained in LAGO, many reactions are occurring in parallel and series. Some thiophenic species are much more reactive than others. Laboratory studies on single model compounds indicate that the reactivity of the thiophenic compounds increases as the aromatic nature of the compounds increases and as the aromatic substitution increases. Namely, benzothiophene is less reactive than dibenzothiophene, which in turn is less reactive than naphthobenzothiophene and dibenzothiophene is less reactive than methyldibenzothiophene, which in turn is less reactive than dimethyldibenzothiophene. The nature of these reactivity differences has been attributed to electronic density effects surrounding the aromatic sulfur atom. Increased aromatic character and aliphatic side chain substitution cause the electron density surrounding the sulfur atom to increase. This higher electronic density makes the sulfur atom more prone to attack by the PCA molecule.

In a complex mixture like LAGO, this reactivity matrix results in a near continuous set of reaction rates. Under these circumstances, the possibility of minimizing the consumption of oxidant by selectively oxidizing to the sulfoxide is essentially futile. Kinetic studies on systems containing just five thiophenic species clearly indicate that the partial oxidation approach results in a marginal benefit.

Since the partial oxidation approach requires sub-stoichiometric quantities of oxidant (less than 2 moles of oxidant per mole of sulfur), near complete oxidation of the organosulfur compounds in LAGO may be not possible under these circumstances. Without complete oxidation, maximizing hydrocarbon yield via distillation may be not possible. In order to achieve total oxidation in a reasonable residence time, a sufficient amount of excess oxidant is required.

Side Reactions (Equations 4 and 5)

In addition to the primary reactions, several side reactions may be occurring. Experiments indicate that excess active oxygen above and beyond the stoichiometric quantity needed to oxidize all sulfur atoms to their corresponding sulfones does not remain after oxidation is complete. The nature of these side reactions remains unknown at this point.

Although it may be possible to decompose hydrogen peroxide and/or PCA, these side reactions do not occur at the normal reaction temperatures anticipated for the invention process. If decomposition does occur, one of the byproducts would be oxygen. Experiments designed to capture any non-condensable gases formed by decomposition gave negative results.

Literature sources indicate that it is possible to oxidize light aromatic hydrocarbons with PCA. Typically, the byproducts are phenols, aldehydes and ketones. Although there is no definitive proof at this stage of the research effort, it is believed that these side reactions do occur. When the unoxidized sulfur concentration is high, the oxidation of the sulfur atom is favored and is significantly faster. As the concentration of unoxidized sulfur diminishes, the side reactions become more prevalent, especially at elevated temperatures. This behavior results in wasting oxidant in undesirable oxidation reactions. The invention process accounts for this undesirable shift in reaction path by carefully controlling the temperature of the reaction mixture at several levels. This method allows for the most efficient use of excess oxidant.

Olefins present in the gas oil may be oxidized to an epoxide (Eqn. 4).

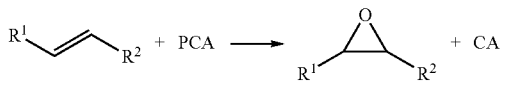

(4)

In straight run gas oils, the quantity of olefins is usually very small. However, if light cycle oils are blended with the straight run gas oil, significant quantities of olefins may be present.

The presence of sulfuric acid in the reaction mixture also creates an environment for the possible formation of sulfonates (Eqn. 5). Normally, sulfonations are conducted at

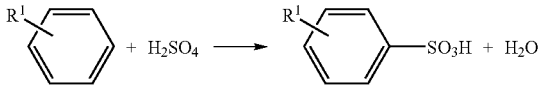

(5)

moderate temperatures (176° F. (80° C.) to 320° F. (160° C.)) with high sulfuric acid concentrations. In the present oxidation system, the sulfuric acid may be typically below 10,000 ppm and the temperature may be typically at or below 176° F. (80° C.). Therefore, the extent of sulfonation is believed to be minor. However, at one point in the present oxidation system, temperatures are as high as 392° F. (200° C.) and sulfuric acid concentrations are approximately 20,000 ppm. In this environment, the sulfonation reactions may become more likely. These sulfonation reactions are most likely to occur in the heavy phase. Due to the water content of the heavy phase, most, if not all of the sulfuric acid used to catalyze the formation of PCA may be present in the this phase. As mentioned previously, the heavy phase contains a significant quantity of CA as well. The presence of CA in the heavy phase causes a significant increase in the solubility of both monocyclic and polycyclic aromatic compounds.

As noted above, PCA present in the system may be destroyed. The solution chemistry associated with this destruction is outlined as follows.

Destruct Reaction (Equations 6 and 7)

After oxidation is complete, the light phase leaving the oxidation system may still contain small amounts of excess active oxygen that should be removed. By elevating the temperature at specific points, the invention process forces the decomposition of both hydrogen peroxide and percarboxylic acid. The reaction stoichiometry for each of these decompositions is shown below.

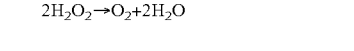

$$2H_2O_2 \rightarrow O_2 + 2H_2O \quad (6)$$

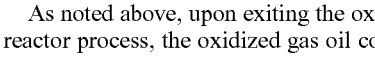

$$2PCA \rightarrow 2CA + O_2 \quad (7)$$

As noted above, upon exiting the oxidation portion of the reactor process, the oxidized gas oil comprising polar organosulfur compounds may be saturated with carboxylic acid. This oxidized gas oil is then fed to the Sulfox Extraction System.

In the Sulfox Extraction System, the residual PCA in the oxidized gas oil is first destroyed by heating to 230° F. (110° C.) for a period of time. At this temperature, PCA in the gas oil undergoes decomposition to oxygen and carboxylic acid. The resulting gas oil is then fed to an extraction column where most of the oxidized organosulfur compounds are removed by contacting with recycled carboxylic acid. The extraction temperature is about 113° F. (45° C.). The recycle solvent is mostly CA and contains about 0.6 wt % water and about 5.4 wt % of hydrocarbon. Given a starting sulfur content of 5100 $ppm_w$ in the feed, a sulfur removal of greater than 99 percent is obtained in this extraction step. The resulting extract that contains most of the oxidized organosulfur compounds is fed to the Solvent Flash/Solvent Recovery System. The gas oil raffinate that is still saturated with CA and contains small amounts of organosulfur compounds is fed to the Raffinate Wash System.

The gas oil raffinate that exits the Sulfox Extraction portion of the reactor process may be saturated with CA and may comprise a small amount of polar organosulfur compounds. Accordingly, a stage in the process designed to remove these impurities is denoted as the Raffinate Wash System, and is discussed briefly as follows.

In the Raffinate Wash System, CA is removed from the gas oil by contacting with water in a mechanically agitated extraction column. The extraction is conducted at about 113° F. (45° C.) and the resulting gas oil raffinate contains approximately 5800 ppm by weight of acetic acid. The extract is fed to the Solvent Purification System for recovery of the extracted CA and the purification of the water. The gas oil raffinate is fed to the Raffinate Polishing System.

In the Raffinate Polishing System, the remaining organosulfur compounds and CA are removed from the raffinate gas oil in a solid bed adsorption column. Currently, the design of the adsorption beds is based on refinery clay. The ability of this material to adsorb sulfones has been demonstrated in the laboratory. A purpose of this portion of the invention is to obtain a product gas oil which comprises less than 10 ppm by weight sulfur and essentially no acetic acid.

The heavy phase extract obtained from the Sulfox Extraction portion of the process is transported to the Solvent Flash/Recovery System, in which CA may be removed from the extract produced in the Sulfox Extraction System. First, most of the CA may be removed in a single stage flash. The resulting extract, comprising approximately 15 wt % CA is then fed to a small distillation column. In this column, the CA content of the extract is reduced to approximately 2 wt % before being fed to the Hydrocarbon Recovery System. The recovered CA from the single stage flash and the distillation column may be combined. This recovered CA comprises light hydrocarbons that form minimum boiling homogeneous azeotropes with the acetic acid. Most of the recovered CA is recycled to the Oxidation System and to the Sulfox Extraction System. However, in order to control the build up of azeotropic hydrocarbons in these recycle loops; a portion of the recovered CA is fed forward to the Solvent Purification System.

In the Solvent Purification System, a distillation column is utilized to separate CA from water and azeotropic hydrocarbons. The feed streams to this distillation column comprise a stream comprising CA and water generated in the Oxidation System, a stream comprising CA and water generated in the Raffinate Wash System, and a stream comprising CA and hydrocarbon generated in the Solvent Flash/Recovery System. Due to the high water content and reduced CA content, the distillate resulting from this column is a heterogeneous azeotrope. Upon condensing, two liquid phases result. The hydrocarbon rich phase is combined with the gas oil feed to the Raffinate Wash System for recovery of the hydrocarbon and recovery of the carboxylic acid. The water phase that contains small quantities of CA and small quantities of hydrocarbon is split into two streams. One stream is purged from the system. This stream preferably comprises the water that enters the process with hydrogen peroxide and the water produced from the formation of PCA (Eqn. 1). The other water stream is recycled to the Raffinate Wash System as the extraction solvent.

In the Hydrocarbon Recovery System, the concentrated extract from the Solvent Flash/Recovery System is distilled under vacuum to recover the hydrocarbon content. Vacuum distillation is necessary due to the high boiling points of the sulfones contained in this extract stream. The overhead product from this distillation is hydrocarbon with 2.7 wt % CA. This material is combined with the gas oil feed to the Raffinate Wash System for recovery of the hydrocarbon and the recovery of the CA. The material leaving the bottom of the vacuum distillation is a combination of hydrocarbon and sulfones. The sulfone content is approximately 32 wt %. This vacuum distillation recovers approximately 80 percent of the hydrocarbon in the feed to this system. As a result, the overall hydrocarbon yield for the entire process is about 90 percent. Theoretically, the overall hydrocarbon yield could be as high as 97 percent. Experimentation on extract distillation followed by additional process engineering optimization is necessary to determine the feasibility of higher hydrocarbon yields, for example, higher steam pressures in the reboiler or deeper vacuum levels in the distillation column would allow additional hydrocarbon recovery.

typical small to medium petroleum refinery that has limited or no hydrodesulfurization (HDS) capability or has limited availability of hydrogen.

For the purpose of the disclosed invention, one of ordinary skill would understand that the process and design comprises all equipment necessary for desulfurization that normally does not exist in a typical refinery.

It is noted that a feed capacity can range from as low as 5 Barrel Per Stream Day (BPSD) to as much as 50,000 BPSD, which includes 10, 15, 20, 25, 30, 40, 50, 100, 250, 500, 750, 1000, 2500, 5000, 7500, 10000, 15000, 20000, 25000, 30000, 35000, 40000, and 45000 BPSD and range therein between and combination thereof.

Figure 2:
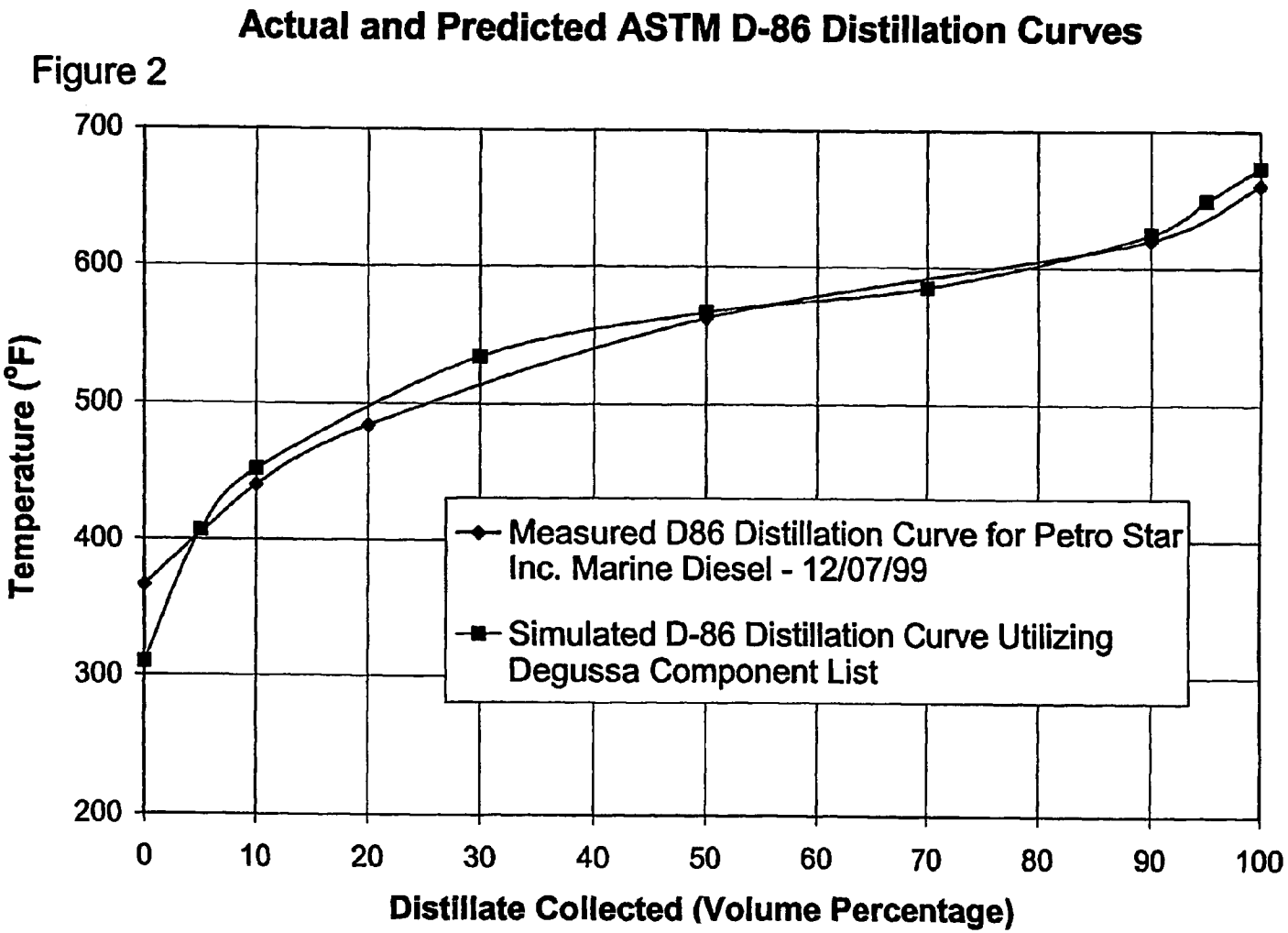
FIG. 2 is plot of Temperature (° F.) versus Distillate Collected (Volume Percentage) of comparative distillation curves.

Initial pilot plant studies were conducted using a middle distillate (Marine Diesel) obtained from Petro Star Inc. In particular, an ASTM D-86 Distillation Curve was measured for the Petro Star Inc. Marine Diesel (Dec. 7, 1999), the results of which are shown in FIG. 2.

A simulated process is outlined below; wherein the feed employed for this simulated process was modeled to mimic a typical straight run LAGO derived from the crude atmospheric distillation unit in a typical petroleum refinery, i.e., Petro Star Inc. Marine Diesel (Dec. 7, 1999). The measured and simulated distillation curves for the actual feed is shown in FIG. 2 and the components in the simulated feed are listed in Table 1.

TABLE 1

| Boiling Fraction ° F. | Aliphatic Components | Aromatic Components | Thiophenic Components | Thiophenic Boiling Point ° F. | Sulphone Boiling Point ° F. |
|---|---|---|---|---|---|
| <156 | n-Hexane | | | | |
| 156-209 | 2,2-Dimethylpentane | Benzene | | | |
| 209-258 | cis-1,2-Dimethylcyclopentane | Toluene | | | |
| 258-303 | 2,4,4-Trimethylhexane | Ethylbenzene | | | |
| 303-345 | 3,3,5-Trimethylheptane | Isopropylbenzene | | | |
| 345-385 | n-Butylcyclohexane | o-Diethylbenzene | | | |
| 385-421 | n-Undecane | 1,2,3,4-Tetramethylbenzene | | | |
| 421-456 | n-Dodecane | Naphthalene | Benzothiophene | 427.8 | 726.9 |
| 456-488 | n-Tridecane | 2-Methylnaphthalene | Methylbenzothiophene | 482.8 | 777.6 |
| 488-519 | n-Tetradecane | 2,7-Dimethylnaphthalene | Ethylbenzothiophene | 528.8 | 827.9 |
| 519-548 | n-Pentadecane | 1,2-Diphenylethane | m-Dimethylbenzothiophene | 534.1 | 833.2 |
| 548-576 | n-Hexadecane | Fluorene | 1-Methyl-3-ethylbenzothiophene | 574 | 873.2 |
| 576-602 | n-Heptadecane | 1-n-Pentylnaphthalene | 1,2,3-Trimethylbenzothiophene | 600.7 | 899.8 |
| 602-626 | n-Octadecane | 1-n-Hexylnaphthalene | Dibenzothiophene | 628.6 | 927.8 |
| 626-651 | n-Nonadecane | Anthracene | Dibenzothiophene | 628.6 | 927.8 |
| 651-674 | n-Eicosane | 1,1,2-Triphenylethane | Naphthothiophene | 676 | 975.2 |
| 674-695 | n-Heneicosane | 1,1,2,2-Tetraphenylethane | Methyldibenzothiophene | 683.6 | 982.7 |
| 695-716 | n-Docosane | m-Terphenyl | 2-Methylnaphthothiophene | 717.7 | 1016.8 |
| >716 | n-Tricosane | Pyrene | Ethyldibenzothiophene | 729.6 | 1028.7 |

Neutralization Reaction (Equations 8 and 9)

The process includes a section where wastewater is treated. This wastewater stream contains CA and sulfuric acid that must be neutralized before disposal. The neutralization may be accomplished by utilizing sodium hydroxide. The products of this neutralization are sodium carboxylate (NaC) and sodium sulfate. The use of other neutralizing bases may be possible.

$$CA+NaOH\ NaC+H_2O \quad (8)$$

$$H_2SO_4+NaOH \rightarrow Na_2SO_4+2\ H_2O \quad (9)$$

The disclosed process may be achieved by a reactor design, which is as follows. The design is particularly suitable for a The feed contains about 5,100 ppm by weight of sulfur in the form of thiophenic compounds including benzothiophene, dibenzothiophene, naphthobenzothiophene, and several of their substituted homologues. This corresponds to a thiophenic composition of 2.89 wt %. The aliphatic content of the feed is about 66.4 wt % while the non-sulfur containing aromatic content of the feed is about 30.7 wt %.

DETAILED DISCUSSION OF A SIMULATED REACTOR AND PROCESS

A better appreciation of the disclosed invention may be made without limiting the scope of the invention by inspecting the details associated with a simulated process, which is represented pictorially in FIGS. 3-7, and described in the following text. In the following text, numerical ranges are presented showing the range of values in which the process may occur. Next to the numerical ranges, preferred values are shown in parentheses.

As a guide for better understanding the figures, it should be noted that solid lines indicate continuous flow, while dashed lines indicate intermediate flow. Streams flowing throughout the process are designated numerically (Stream Nos. 1-50)—these numbers being enclosed within hexagons and located proximal to the stream in question. The simulated material balances and properties of the streams are tabulated in Tables 2-14 and appear below. Reactors, columns, vessels, tanks, heat exchangers, pumps, and the like, are represented numerically (100-172). When different from the data shown in the tables, stream physical properties are presented as numbers within various geometrical shapes; e.g., stream temperature (number in ° F. enclosed in a rectangle), stream pressure (number in psia enclosed in oval), and stream mass flow (number in lb/hr enclosed in curved rectangle (▭)). Other representations will be recognized by one of ordinary skill. For convenience, streams that lead to reactors, vessels, and the like that appear in separate figures are so labeled along the periphery of the figure with a directional indication of flow and a numerical designation showing the source/destination of the stream.

In this illustrated embodiment, the first liquid comprises a middle distillate (Marine Diesel) obtained from Petro Star Inc. The selected carboxylic acid is acetic acid, which means that reaction of acetic acid (AA) with hydrogen peroxide results in the formation of peracetic acid (PAA) as shown in eqn. (1).

Oxidation Stage (FIG. 3)

The organosulfur compounds in the gas oil feed (first liquid) are substantially completely oxidized to polar organosulfur compounds via reactions with active oxygen in the form of PAA. As noted above, PCA may be formed in situ by reacting hydrogen peroxide with acetic acid. The overall conversion of thiophenic sulfur to sulfones is 99.8%. A total of ranging between 2.5 to 5.0 (3.0) moles of hydrogen peroxide per mole of sulfur are used in the oxidation.

In the discussion concerning the solution chemistry of the oxidation process, the reaction mixtures in the Oxidation System comprise two liquid phases. The formation of PCA occurs in the heavy phase while the oxidation of organosulfur compounds to polar organosulfur compounds occurs in both phases. Sulfuric acid, hydrogen peroxide, and water primarily reside in the heavy phase. AA, PAA, thiophenics, and sulfones distribute between both phases. Hydrocarbons primarily stay in the light phase, although some of the aromatic compounds and, to a lesser extent, some of the aliphatic compounds in the gas oil are soluble in the heavy phase.

FIG. 3 shows a detailed depiction of the oxidation system. In particular, the Oxidation System utilizes two reactors (100A and 104A), two decanters (101A and 106), a reboiled flash vessel (108A), and three heat exchangers (102A, 105A, and 109A).

Fresh gas oil (Stream No. 1) may be introduced at a temperature of about 68° F. where it may be first partially heated in a heat exchanger (105A) by a higher temperature downstream process fluid (Stream 7). The temperature of the fresh gas oil stream upon departure from the heat exchanger (105A) may be increased before introduction to the reactor (100A) by introducing said stream to a second heat exchanger (102A, which employs 150-psig steam) prior to the introduction of recycled acetic acid. The introduction of recycled AA from the Solvent Flash/Recovery System (Stream No. 29) which may be at a temperature of about 300° F. (148.9° C.) to the fresh gas oil stream occurs prior to entry into the First Stage Oxidizer (100A). Approximately, one pound of recycled AA is used for every five pounds of gas oil; wherein the combined stream has a temperature of about 176° F. (80° C.) (Stream No. 5). The combined gas oil/AA stream is then fed to the First Stage Oxidizer (100A). Recycled oxidant (Stream No. 16) from the Second Stage Oxidizer Oil Decanter (106) is also fed to the First Stage Oxidizer (100A). This recycled stream comprises approximately 1.8 to 3.0 moles of oxidant per mole of sulfur in the gas oil feed to the First Stage Oxidizer (100A); preferably about 2.5 moles of oxidant per mole of sulfur in the gas oil feed to the First Stage Oxidizer (100A). In addition to oxidant, this recycle stream comprises the catalyst comprising sulfuric acid. As noted above, the temperature of the combined feed (Stream No. 5) to the First Stage Oxidizer (100A) may range from about 140° F. (60° C.) to about 194° F. (90° C.), preferably (176° F. (80° C.)). Obviously, the precise temperature may be dependent upon the temperatures of both the heated feed gas oil and the recycled acetic acid.

With an aim not to be limited by theory, it is believed that addition of AA to the gas oil prior to contacting with oxidant is important for maintaining a relatively high concentration of PAA in the heavy phase within the First Stage Oxidizer (100A). Due to the relatively high AA distribution coefficient, if the gas oil does not comprise sufficient acetic acid, redistribution may occur when the oxidant solution contacts the gas oil. This redistribution may cause a decrease in the AA concentration in the heavy phase. This in turn may cause some of the PAA in the heavy phase to revert back to AA and hydrogen peroxide in order to satisfy the reaction equilibrium conditions. Due to a less favorable distribution coefficient, hydrogen peroxide is not as effective as PAA, and therefore, an overall decrease in reaction rate would result.

The presence of sulfuric acid in the First Stage Oxidizer (100A) is also important. When the oxidant solution contacts the gas oil, PAA will distribute between the two phases. In the heavy phase, compensation for departure from reaction equilibrium conditions can best occur if the rate of PAA formation is relatively fast. Rapid PAA formation is best obtained in the presence of a strong acid catalyst like sulfuric acid.

In the First Stage Oxidizer (100A), the bulk of the organosulfur compounds may be converted to sulfones. Approximately, 96 to 99 percent conversion (98 percent) may be obtained within a residence time of about 5 to 30 minutes (20 minutes). On the whole, the reactor is designed to operate under adiabatic conditions at a pressure of 17 pounds per square inch absolute (psia). The two liquid phases flow concurrently upward through the reactor, yet as the reaction proceeds, the heat generated by oxidation causes the temperature of the reaction mixture to increase. An outlet temperature may range from 145° F. (62.8° C.) to 200° F. (93.3° C.) (181° F. (82.8° C.)). The first stage oxidizer serves to provide enhanced contact between the two liquid phases. Mass transfer of PAA from the heavy phase to the light phase may dictate the overall reaction rate.

The reaction mixture (Stream No. 6) that leaves the First Stage Oxidizer (100A) is fed to the First Stage Oxidizer Oil Decanter (101A) where the two liquid phases (light and heavy phases) may be separated by gravity settling. In this particular portion of the overall process, the light phase is referred to as the first Stage Light Phase (Stream No. 7) and the heavy phase is referred to as the first Stage Heavy Phase (Stream No. 8).

The First Stage Oxidizer Decanter (101A) operates at a pressure of about 17 psia. The light phase comprises mostly hydrocarbon and acetic acid, sulfones, and about 100 ppm by weight sulfur in the form of unoxidized thiophenics. The heavy phase comprises mostly AA and water. However, this phase may further comprise sulfuric acid, sulfones, and some hydrocarbon. Due to the extended time at elevated temperatures, the amount of active oxygen either in the form of hydrogen peroxide or in the form of PAA is expected to be close to zero in both phases. The temperature of the light phase upon departure of the First Stage Oxidizer Oil Decanter (101A) is about 181° F. (82.8° C.).

The light phase is pumped (103A) to the Second Stage Oxidizer (104A). The heavy phase is fed forward by gravity to the Water Flash Vessel (108A).

In the Water Flash Vessel (108A), a portion of the heavy phase from the outlet of the First Stage Oxidizer (100A) is vaporized and sent as a vapor to the Solvent Purification Column (139; Stream No. 9). The Water Flash Vessel (108A) operates at about 18 psia. The heat required for vaporization is supplied by the Water Flash Vessel Reboiler (109A) by way of medium pressure (MP) steam, but high pressure (HP) steam may be used as well or a combination of the two. Vaporization may be conducted at about 18 psia and a temperature of 240° F. (115.6° C.) to 410° F. (210° C.) (249° F. (120.6° C.)). The resulting vapor stream comprises mostly AA and about 2 to 20 wt % of water (9 wt %). The liquid remaining after vaporization comprises primarily AA, sulfones, hydrocarbon, a small amount of water, and about 2 wt % sulfuric acid. Most of this liquid (Stream No. 11) is pumped (110A) to the inlet of the Second Stage Oxidizer (104A). A portion (Stream No. 12) is purged from the Oxidation System and sent to the Wastewater Neutralization Vessel (167). The AA lost in this stream represents approximately 43 percent of the overall AA loss.

The water entering the system with the fresh hydrogen peroxide feed (Stream No. 4) and the water generated within the system during the formation of PAA is removed via partial vaporization of the heavy phase leaving the first stage reactor as described above. Although water generated during the formation of PAA is primarily formed within the Second Stage Oxidizer (104A), removal of this water from the Oxidation System can not be accomplished until after contact in the First Stage Oxidizer (100A). The high temperatures used for vaporization would cause rapid and total decomposition of the active oxygen.

The sulfuric acid used to catalyze the formation of PAA is theoretically unused during the reaction sequence. Therefore, total recycle of the sulfuric acid catalyst is theoretically possible. However, the fresh hydrogen peroxide entering the Oxidation System comprises stabilizers in the form of non-volatile salts. These salts are soluble in water and tend to remain in the heavy phase circulating in the Oxidation System. Total recirculation of the heavy phase, after water removal via vaporization, would therefore result in an unchecked accumulation of the stabilizers. A heavy phase purge is therefore required to limit the accumulation of stabilizers. Unfortunately, this heavy phase purge also results in a loss of sulfuric acid from the Oxidation System. Therefore, fresh sulfuric acid must be added to negate these sulfuric acid losses, and any losses due to side reactions of sulfuric acid.

The gas oil feed to the Second Stage Oxidizer (104A) may be first cooled to about 122° F. (50° C.) to about 158° F. (70° C.) (130° F. (54.4° C.)); so that upon intro aqueous feed (Stream No. 11) coming from the Water Flash Vessel (108A) the combined feed will be about 140° F. (60° C.). In addition to this feed, fresh oxidant from storage (Stream No. 4) and fresh catalyst from a pipeline (Stream No. 2) may be added to the gas oil feed at some point prior to the introduction to the Second Stage Oxidizer (104A). In addition, the heavy phase is fed forward from the Water Flash Vessel to the inlet of the Second Stage Oxidizer (104A).

In the Second Stage Oxidizer (104A), the solvent comprising acetic acid and fresh oxidant comprising hydrogen peroxide come in contact to form PAA in situ; wherein most of the unoxidized thiophenic compounds in the feed are converted to sulfones. Approximately 88 to 95 percent (90 percent) conversion based on the unoxidized sulfur content of the second stage feed may be obtained with a residence time of about 15 to 80 minutes (20 minutes). The reactor may operate under adiabatic conditions at a pressure of 17 psia The two liquid phases may move concurrently in a pipe flow reactor. The temperature rise in this reactor is expected to be near zero, since the heat of reaction for the formation of PAA is very small and the amount of oxidation compared to the total mass flow is also very small. The Second Stage Oxidizer (104A) may provide enhanced contact between the two liquid phases. Mass transfer of PAA from the heavy phase to the light phase is again crucial to the overall reaction rate.

The reaction mixture that leaves the Second Stage Oxidizer (104A; Stream No. 14) is fed to the Second Stage Oxidizer Oil Decanter (106) where the two liquid phases are separated by gravity settling. This decanter (106) operates at a pressure of about 17 psia. The light phase comprises mostly hydrocarbon, AA, and smaller amounts of PAA, sulfones and approximately 10 ppm by weight of unoxidized thiophenics. The heavy phase comprises mostly AA and water, and smaller amounts of hydrogen peroxide, PAA, sulfuric acid, sulfones, and some hydrocarbon.

Efficient use of oxidant is accomplished by first feeding fresh oxidant to the Second Stage Oxidizer (104A) and then recycling the unused oxidant from the outlet of the Second Stage Oxidizer (104A) to the inlet of the First Stage Oxidizer (100A). This flow path for the oxidant provides a high concentration of active oxygen in the Second Stage Oxidizer (104A) where the concentration of unoxidized organosulfur compounds is very low. The Second Stage Oxidizer (104A) operates at low temperature to minimize the consumption of oxidant in undesirable side reactions. Therefore, the heavy phase leaving the Second Stage Oxidizer (104A) comprises a substantial amount of unused oxidant. This makes the heavy phase from the Second Stage Oxidizer (104A) an ideal candidate for recycling back to the First Stage Oxidizer (100A).

The light phase from the Second Stage Oxidizer Oil Decanter (106) is fed via gravity to the Sulfox Extraction System (Stream No. 15). The heavy phase from the Second Stage Oxidizer Oil Decanter (106) is recycled (Stream No. 16) via 107 to the inlet of the First Stage Oxidizer (100A).

Sulfox Extraction and Raffinate Washing (FIG. 4)

In Sulfox Extraction and Raffinate Washing, small amounts of oxidant may be removed from the raffinate by heat treatment and then most of the organosulfur compounds and AA may be removed from the gas oil via liquid-liquid extraction. Besides the gas oil fed forward from the Oxidation System, the recovered gas oil from the Solvent Purification System and the Hydrocarbon Recovery System are also treated in this system. The gas oil leaving this system contains approximately 50 ppm by weight of sulfur and approximately 6000 ppm by weight of acetic acid.

A better understanding of the Sulfox Extraction and Raffinate Washing System may be gleaned by inspecting a pictorial depiction of a preferred embodiment shown in FIG. 4. In this representation, the Sulfox Extraction and Raffinate Washing System may utilize a stirred tank reactor (112), a packed extraction column (119), a mechanical extraction column (122), heat exchangers (114-118, and 120), and pumps (113, 121, 123, and 125). Gas oil hold up is provided at the end of this system by a simple vertical vessel (124).

Fresh gas oil enters this system (Stream No. 15) may range between 122° F. (50° C.) to 158° F. (70° C.) (140° F. (60° C.)) from the Oxidation System via gravity from the Second Stage Oxidizer Oil Decanter (106). Prior to entering the Destruct Reactor (112), the gas oil may be heated in a heat exchanger (115), by interchanging heat with the discharge stream from the Destruct Reactor and in heat exchanger (114) by interchanging heat with the recycle solvent stream from the Solvent Recovery/Solvent Purification System. This heat recovery system raises the temperature of the gas oil to the desired Destruct Reactor (112) temperature that ranges from 212° F. (100° C.) to 250° F. (121° C.) (230° F. (110° C.)).

In the Destruct Reactor (112), any small amounts of oxidant may be decomposed to oxygen and acetic acid (see Eqn. 7). The residence time in the reactor may vary from about 5 to about 20 minutes (10 minutes). An agitator (111) may be provided, for example, to maintain a homogeneous mixture. For startup purposes, the Destruct Reactor (112) may be equipped with a jacket serviced by 150 psig steam. Under steady state conditions, steam heating is not required. That is, the heat duty of the Destruct Reactor (112) may be about 0 MMBtu/hr; consequently, the temperature of the stream exiting the Destruct Reactor (112) is about the same temperature as the stream that enters the reactor.

The gas oil (Stream No. 17) leaving the Destruct Reactor may be pumped (113) to the Sulfox Extraction Column (119), but is cooled by successively passing through three heat exchangers (115, 117, and 120). Before entering the extraction column, the gas oil is cooled from a temperature of about 230° F. (110° C.) to about 189° F. (87.2° C.) via a heat exchanger (115), by interchanging heat with the feed stream (Stream No. 15) to the Destruct Reactor (112). (As noted above, the temperatures obtained during the simulated reactor process are shown as numbers enclosed by rectangles.) Further downstream, the gas oil is cooled (about 189° F. (87.2° C.) to about 147° F. (63.9° C.)) further via heat exchanger (117), which in turn may be accomplished by interchanging heat with the extract stream from the Sulfox Extraction Column (119). Finally, prior to the introduction of the gas oil to the Sulfox Extraction Column (119), the gas oil is cooled further (about 147° F. (63.9° C.) to about 113° F. (45° C.)) by way of a heat exchanger (120), which may be cooled by cooling water (see utilities above).

The solvent used in the Sulfox Extraction Column is a combination of crude AA (Stream No. 30) from the Solvent Flash Vessel Distillate Receiver (134) and clean AA (Stream No. 38) from the bottom of the Solvent Purification Column (139). This combined solvent is cooled to extraction temperature by successively passing through three heat exchangers (114, 116, and 118). (The temperatures obtained during the simulated reactor process are shown as numbers enclosed by rectangles.) The first heat exchanger (114) cools by interchanging heat with the feed stream to the Destruct Reactor (112). The second heat exchanger (116) cools by interchanging heat with the extract stream from the Sulfox Extraction Column (119). Finally, the third heat exchanger (118) cools by circulated cooling water (see utilities above). The extract (Stream 19) leaves via pump 121 through heat exchangers 117 and 116 and is combined with Stream 24 before being delivered to flash evaporator 136 (FIG. 6).

In the Sulfox Extraction Column (119), more than 99 percent of the polar organosulfur compounds comprising sulfones may be removed from the gas oil.

There are three key process parameters associated with the Sulfox Extraction Column: (i) extraction temperature, (ii) water content of the extraction solvent, and (iii) the solvent-to-feed ratio. The current design is based on an extraction temperature that may range from about 100° F. (37.8° C.) to 150° F. (65.6° C.) (113° F. (45° C.)); solvent water content that may range from about 0.4 to 3.0 wt % (0.6 wt %); and a solvent-to-feed ratio that may range from about 1 to 2 (1.25). Of course, any combination of values for the three parameters may be realized for optimal performance of the extraction column.

Higher extraction temperatures and higher solvent-to-feed ratios would favor the removal of sulfones. Increased sulfone removal may result in a smaller Raffinate Polishing System. Unfortunately, these same higher temperatures and higher solvent-to-feed ratios simultaneously increase the amount of hydrocarbons that may be removed from the gas oil, thereby reducing yield in this system and increasing the capacity of the Hydrocarbon Recovery System. In addition, higher solvent-to-feed ratios also increase the capacity and energy requirements of the solvent recovery system. Lower temperatures may be undesirable since special utility fluids such as chilled water would be necessary for cooling the feeds to the extraction column.

Higher water content may decrease the amount of hydrocarbon to be extracted from the gas oil, thereby decreasing the amount of hydrocarbon processed in the Hydrocarbon Recovery System. Obviously the interplay of many factors, including the precise effect of water content, will determine the ability of the solvent to extract sulfones.

The extract leaving the bottom of the Sulfox Extraction Column is pumped (121) to the Solvent Recovery/Solvent Purification System (FIG. 6). Before leaving the Sulfox Extraction and Raffinate Washing System, this relatively cold stream is used to cool the gas oil feed and the solvent feed to the Sulfox Extraction Column (119).

The raffinate (Stream No. 18) leaving the top of the Sulfox Extraction Column may be combined with the azeotropic hydrocarbon (Stream No. 36) and recovered hydrocarbon (Stream No. 49) streams from the Solvent Recovery and Solvent Purification System (FIG. 6) and the Hydrocarbon Recovery System (FIG. 7), respectively. In addition, the spent gas oil (Stream No. 25) used to rinse AA from the adsorption beds in the Raffinate Polishing System (FIG. 5) may also be added to this stream.

The combined gas oil (Stream No. 20) obtained from the Sulfox Extraction Column (119), the Solvent Recovery and Solvent Purification System (FIG. 6), the Hydrocarbon Recovery System (FIG. 7) and the Raffinate Polishing System (FIG. 5) may be fed to the bottom of the Raffinate Wash Column (122). This treatment serves to remove any unwanted AA from the gas oil feed.

In the Raffinate Wash Column (122), most of the AA may be removed from the gas oil by washing with substantially pure water (e.g., tap water with low mineral content, deionized water, distilled water, recycled water from solvent purification or combinations thereof). When this wash water is recycled from the Solvent Recovery and Solvent Purification System (FIG. 6), it comprises approximately 0 wt % to 5 wt % (1.5 wt %) acetic acid.

There is one key process parameter associated with the Raffinate Wash Column (122). This key parameter is the solvent-to-feed ratio. The simulated design is based on a solvent to feed ratio of about 0.05, however, this ratio may range from 0.025 to 0.1; wherein a higher solvent-to-feed ratio results in higher AA recovery. Unfortunately, a drawback of having too high of a solvent-to-feed ratio necessitates a higher energy requirements in the Solvent Recovery and Solvent Purification System.

The washing temperature may range from about 100° F. (37.8° C.) to about 125° F. (51.7° C.) (113° F. (45° C.)); and may primarily depend on the temperature of the gas oil leaving the Sulfox Extraction Column.

The extract leaving the bottom of the Raffinate Wash Column (122) is pumped (123; Stream No. 21) to the Solvent Purification Column (139) where the AA is recovered and the water is purified for recycle.

The raffinate leaving the top of the Raffinate Wash Column (122) flows via gravity to the Raffinate Hold Vessel (124). This vessel provides about 20 minutes of surge time. From the Raffinate Hold Vessel (124), the gas oil may be pumped (125) to the Raffinate Polishing System (126; Stream No. 22).

Raffinate Polishing (FIG. 5)

In the Raffinate Polishing System, small amounts of sulfur containing compounds and small amounts of AA are removed by adsorption onto a solid bed adsorbent. The sulfur content of the gas oil may be reduced to 10 ppm or less. It is estimated that the AA content may be reduced to 10 ppm or less.

The current design of this system is based on an observation that refinery clay serves generally as an effective adsorbent for polar organic compounds, particularly polar organic compounds and acetic acid. A particular type of refinery clay, also known as Fuller's Earth, may be used. However, it is believed that other forms of adsorbent material may be used, such as zeolites in general, silica, diatomaceous earth, natural adsorbents, unnatural adsorbents, mixtures thereof, or combinations thereof. Obviously many parameters may influence the manner in which polar organic compounds are adsorbed onto the column material; this may lead to a variety of adsorption system process parameters that may be optimized, e.g., type and/or amount of adsorbent material, temperature and/or pressure of the adsorption process and regeneration methods, etc.

The Raffinate Polishing System utilizes two parallel adsorption columns (126 and 129), one holding tank (127), two holding vessels (130 and 132), and three pumps (128, 131, and 133). One of the adsorption columns serves to polish the gas oil while the other adsorption column is being regenerated. The overall cycle may be about 12 hours.

For example, gas oil (Stream No. 22) from the Raffinate Holding Vessel (124) is fed to one of the Raffinate Polishing Columns (126). Organosulfur compounds and AA are adsorbed onto the solid bed as the gas oil flows through the column for about a 6-hour period. Upon exiting the column, the purified gas oil flows via gravity to the Product Hold Tank (127). After checking the quality, the gas oil (Stream No. 23) is pumped intermittently (128) to storage that may be outside the battery limits of the inventive process.

During the same time period, the other Raffinate Polishing Column (129) is being regenerated. First, clean recycled AA is pumped through the bed. Organosulfur compounds left on the solid bed adsorbent by the crude gas oil are now desorbed by the acetic acid. Upon exiting the top of the column, the spent AA flows to the Spent AA Hold Vessel (130). This operation requires about 3 hours. Then, desulfurized gas oil from the Product Hold Tank (127) is pumped by 128 upward through the bed. The clean gas oil desorbs AA left on the bed from the previous step. Upon exiting the top of the column, the spent gas oil flows to the Spent Gas Oil Hold Vessel (132). This operation also requires about 3 hours.

The spent AA in the Spent AA Hold Vessel (130) may be continuously pumped (131) to the Solvent Recovery and Solvent Purification System (FIG. 6) where the AA is recovered and the polar organosulfur compounds removed from the gas oil via adsorption join the balance of the sulfur extract. The spent gas oil in the Spent Gas Oil Hold Vessel (132) is continuously pumped (133) to the Sulfox Extraction Column and Raffinate Wash System (FIG. 4) where the AA and gas oil are recovered.

Solvent Recovery and Solvent Purification (FIG. 7)

In the Solvent Recovery System, the bulk of the AA is separated from the sulfur extract for immediate recycle. In the Solvent Purification System, mixtures of acetic acid, water, and hydrocarbons from several sources within the process are purified for recycle and purging.

The Solvent Flash and Solvent Purification System utilizes a single stage flash vessel (136) with accompanying heat exchangers (137 and 138); and a packed distillation column (139) with a vessel (142) and heat exchangers (141, 143, and 145).

The combined stream comprising the Sulfox Extraction Column (119) bottom extract (Stream No. 19) and the spent AA (Stream No. 24) from the Spent AA Hold Vessel (130) may be fed to the Solvent Flash Vessel (136). The Solvent Flash Vessel Reboiler (138) may be used to vaporize a large portion of the feed with 300-psig steam.

The resulting bottoms stream (Stream No. 28) comprising sulfur extract and approximately 15 wt % (10 to 50 wt %) AA may be sent forward to the Solvent Recovery and Hydrocarbon Recovery System.

The flashed vapor (Stream No. 27) is condensed in the Solvent Flash Vessel Overhead Condenser (137) and then may flow via gravity to the Solvent Flash Vessel Distillate Receiver (134). The condensed distillate comprises mostly AA with about 3 to 12-wt % hydrocarbon (7-wt %). This hydrocarbon is mostly light boiling aliphatic and aromatic compounds that form minimum boiling homogeneous azeotropes with acetic acid.

The Solvent Flash System operates between a range from about 17 to about 75 psia (45 psia). An elevated pressure may be utilized to establish a higher condensing temperature in the Solvent Flash Vessel Overhead Condenser (137). This elevated temperature allows heat integration with the bottoms of the Solvent Purification Column (139) by providing most of the reboiler heat duty required.

The condensed liquid from the Solvent Flash Vessel Overhead Condenser (137) flows via gravity to the Solvent Flash Vessel Distillate Receiver (134). This vessel provides about 15 minutes of surge capacity for the unit operations that receive recycle solvent. In addition, this vessel is used to monitor the AA inventory within the process unit. Utilizing on/off level control, fresh AA from storage is added to this vessel periodically to make up for AA losses from streams leaving the process.

The crude AA from the Solvent Flash Vessel Distillate Receiver (134) may be pumped (135) to the First Stage Oxidizer (100A; Stream No. 29), to the Sulfox Extraction Column (119; Stream No. 30), and to the Solvent Purification Column (139; Stream No. 31). The streams flowing to 100A and 119 are recycle streams, while the stream leading to 139 acts as a hydrocarbon purge for the main solvent recycle loops. Without the purge stream to the Solvent Purification Column (139), azeotropic hydrocarbon accumulation would remain unchecked in this recycle loop causing potential problems in the Oxidation System (FIG. 3) and in the Sulfox Extraction System (FIG. 4). The material balance herein is based on a recycle-to-purge weight ratio of about 5.0, but the recycle-to-purge weight ratio may range from about 4 to about 10. Employing a recycle-to-purge ratio of about 5, the crude AA recycle loop comprises hydrocarbon composition that is approximately 7.0 wt %. A higher recycle-to-purge ratio may result in some energy savings in the Solvent Purification Column (139). However, this higher recycle-to-purge ratio also causes a higher hydrocarbon concentration in the recycle streams. Clearly an optimum recycle-to-purge ratio depends upon many factors and conditions.

The Solvent Purification Column (139) receives vapor feed from the Water Flash Vessel (108A; Stream No. 9), liquid feed from the Raffinate Wash Column (122; Stream No. 21), and liquid feed from the Solvent Flash Vessel Distillate Receiver (134; Stream No. 31). The feed stream composition determines the ordering of the feed location, and consequently the respective introduction of each feed stream to the column. There may be at least two feed locations. The column may operate at about 17 psia. In the lower portion of this distillation column, water and light hydrocarbons are stripped from acetic acid. In the upper portion of this distillation column, AA is removed from water and hydrocarbon. The separation accomplished in this column is relatively difficult since the relative volatility between water and AA is low. The heat and material balance for this column is based on a reflux ratio of 3.8 by weight and by employing a total of 38 theoretical stages. Obviously, the optimum configuration and operating conditions depend upon many conditions and factors.

Approximately 90 percent of the heat required by the Solvent Purification Column is supplied by the Solvent Flash Vessel Overhead Condenser (137). Due to layout considerations, forced circulation is utilized for this reboiler. This arrangement allows the liquid condensate on the hot side of this reboiler to flow via gravity to the Solvent Flash Vessel Distillate Receiver (134). The balance of the heat requirement for the Solvent Purification Column is supplied in the Solvent Purification Column Trim Reboiler (143) by employing 150-psig steam. This is a thermosiphon reboiler and is used to control the water content of the streams leaving the bottom of the column.

The stream leaving the bottom of the Solvent Purification Column (139) may be pumped (140) to either the Sulfox Extraction Column (119; Stream No. 38) or to the Solvent Hold Tank (Stream No. 39), or internally recycled to the main reboiler (143). The streams comprise mostly AA with approximately 0.5 wt % water and 1.5 wt % hydrocarbon. The two streams (Stream Nos. 38 and 39) represent the net bottoms output from the distillation column. One of these streams is recycled to the Sulfox Extraction Column (119; Stream No. 38). The other stream is sent to the Solvent Hold Tank (Stream No. 39) where it becomes the recycle stream used to regenerate the adsorption beds in the Raffinate Polishing System (FIG. 5).

Most of the hydrocarbon and water in the feeds to the Solvent Purification Column (139) may be driven overhead. At the top of the column, overhead vapors are condensed in the Solvent Purification Column Overhead Condenser (141). This is a total condenser utilizing cooling tower water as a heat sink. It may be necessary to vent non-condensable gases formed in the Water Flash Vessel (108A) by the decomposition of active oxygen containing species. Since the light hydrocarbons and water form minimum boiling heterogeneous azeotropes, two liquid phases are formed upon condensation (a light phase and a heavy phase). The immiscibility in this condensed stream is due to the high concentrations of water present. The two liquid phases are separated by gravity settling in the Solvent Purification Column Reflux Decanter (142), which operates at a pressure of about 17 psia.

The light phase comprises about 99.6 wt % hydrocarbon and may be recycled via gravity to the bottom of the Raffinate Wash Column (122; Stream No. 36) where the recovered azeotropic hydrocarbon joins the main gas oil stream. The heavy phase which is water rich and contains approximately 1.4 wt % AA is pumped (144) to the Solvent Purification Column as reflux, to the top of the Raffinate Wash Column (122; Stream No. 35) as wash water recycle, and the Wastewater Neutralization Vessel (167; Stream No. 34) as purge. The recycle water to the Raffinate Wash Column (122; Stream No. 36) is cooled in the Solvent Purification Column Water Distillate Cooler (145) by cooling tower water. The purge stream leaving this distillation column represents most the water fed to the Oxidation System (FIG. 3) with the fresh hydrogen peroxide feed and most of the water formed by reaction in the Oxidation System. The AA leaving in this stream represents approximately 30 percent of the total AA losses.

Solvent Recovery and Hydrocarbon Recovery (FIG. 7)

In the Solvent Recovery System, additional AA is separated from the sulfur-rich extract for recycle. In the Hydrocarbon Recovery System, the remaining AA and a large portion of the hydrocarbons in the sulfur-rich extract are recovered for recycle.

The Solvent Recovery and Hydrocarbon Recovery System utilizes a relatively small packed distillation column (149) accompanied by two heat exchangers (146 and 150) and a solvent flash vessel (147), which may operate at atmospheric pressure. Additionally, the Solvent Recovery and Hydrocarbon Recovery System comprises a relatively large packed distillation column (152), three heat exchangers (154, 156, and 157) a Hydrocarbon Recovery Column Reflux Drum (158) all of which may operate under reduced atmospheric pressure (i.e., vacuum). Vacuum may be generated by the Hydrocarbon Recovery Column Vacuum System (166), which is a steam jet package. Condensate from the vacuum system is processed through the Wastewater Neutralization Vessel (167), which acts simultaneously as the seal for the vacuum system barometric legs and as the neutralization point for all wastewater streams leaving the process.

The Solvent Recovery Column (149) receives the sulfur extract stream from the bottom of the Solvent Flash Vessel (136; Stream No. 28). This stream comprises hydrocarbons, approximately 7.3 wt % sulfones, and 15 wt % AA. Above the feed point of the distillation column, hydrocarbon is removed from AA. Below the feed point of the distillation column, AA is stripped from the hydrocarbons and the sulfones. The separation accomplished in this column is relatively easy since the relative volatility between AA and hydrocarbons is high. The heat and material balance for this column is based on a reflux ratio of about 0.5 by weight and a total of 8 theoretical stages. Obviously, optimum configuration and operating conditions depend upon many factors.

Approximately 88 percent of the AA in the feed to the Solvent Recovery Column (149) is sent overhead. Some hydrocarbon and substantially all the water in the feed is also sent overhead. The atmospheric bubble point of the liquid stream leaving the bottom of the distillation column limits additional recovery of acetic acid.

At the top of the column, overhead vapors (Stream No. 40) are condensed in the Solvent Recovery Column Overhead Condenser (146). This is a total condenser utilizing cooling tower water as a heat sink. The condensed liquid flows to the Solvent Recovery Column Reflux Drum (147), which provides approximately 7.5 minutes of liquid surge capacity. The liquid leaving the Solvent Recovery Column Reflux Drum (147) may be pumped (148) to the top of the Solvent Recovery Column (149) as reflux and to the Solvent Flash Vessel Distillate Receiver (134) as recycle.

The heat required by the Solvent Recovery Column (149) may be supplied in the Solvent Recovery Column Reboiler (150) by 300 psig steam. If desired, higher pressure steam could be used to increase AA recovery. Forced circulation is used for this reboiler since there is a significant increase in the bubble point of the liquid as vaporization occurs. The net liquid leaving the bottom of the column may be pumped (151) to the Hydrocarbon Recovery Column (152). This stream (Stream No. 43) may comprise mostly hydrocarbon and approximately 2 wt % AA and 8.5 wt % sulfones.

The Hydrocarbon Recovery Column (152) receives the stream (Stream No. 43) comprising sulfur compounds from the bottom of the Solvent Recovery Column (149). Above the feed point of the distillation column, sulfones are removed from AA and hydrocarbons. Below the feed point of the distillation column, AA and hydrocarbon are stripped from the sulfones. The heat and material balance tabulated herein for this column is based on a reflux ratio of about 0.15 by weight and a total of 8 theoretical stages. Obviously, the optimum configuration of this column depends upon many conditions and factors.

The top of the Hydrocarbon Recovery Column (152) operates at a pressure that ranges from about 5 mm Hg to about 15 mm Hg; preferably about 7 mm Hg to about 13 mm Hg; more preferably about 9 mm Hg to about 11 mm Hg; most preferably about 10 mm Hg. The bottom of this column operates at a pressure that ranges from about 10 mm Hg to about 20 mm Hg (about 15 mm Hg). The pressures utilized in this column were chosen based on a balance between the complexity of the vacuum system, the recovery of hydrocarbon overhead, and the bubble point of the resulting bottom stream. The current process configuration results in a column hydrocarbon recovery of about 80 percent by weight, which increases the overall hydrocarbon recovery for the entire process to at least 90 percent by weight. Deeper vacuum levels and/or higher steam pressures in the reboiler may be used to increase hydrocarbon recovery.

At the top of the column, overhead vapors (Stream No. 44) are condensed in the Hydrocarbon Recovery Column Overhead Condenser (157), which may be cooled using cooling tower water; and the Hydrocarbon Recovery Column Vent Condenser (156), which may be cooled using a 10° F. (−12.2° C.) aqueous brine solution or an aqueous solution comprising 25 wt % ethylene glycol. The vent condenser (156) minimizes losses of AA to the vacuum system. The liquid from both condensers flows to the Hydrocarbon Recovery Column Reflux Drum (158), which provides approximately 7.5 minutes of liquid surge capacity. The liquid leaving the Hydrocarbon Recovery Column Reflux Drum is pumped (159) to the top of the Hydrocarbon Recovery Column (152) as reflux and to the bottom of the Raffinate Wash Column (122; Stream No. 49) as recovered hydrocarbon and acetic acid.

The heat required by the Hydrocarbon Recovery Column (152) is supplied in the Hydrocarbon Recovery Column Reboiler (154), which may employ 300-psig steam. A falling film reboiler is used for this application due to the potential thermal sensitivity of the bottom product. The net liquid leaving the bottom of the column may be pumped (153) through the Hydrocarbon Recovery Column Bottoms Cooler to storage (Stream No. 50). This stream comprises approximately 68 wt % hydrocarbon and 32 wt % sulfones.

The vapor leaving the column vent condenser flows (Stream No. 45) to Hydrocarbon Recovery Column Vacuum System (166), which comprises a three-stage vacuum package utilizing 150-psig steam as the motive fluid and preferably comprising 3 jets (160, 162, and 164) and 3 after-condensers (161, 163, and 165). The net gas leaving the vacuum system is sent to offgas treatment (Stream No 46). Very little AA is lost in this stream. The condensed process liquid and condensed steam from each after condenser flows via gravity through two separate barometric legs and a separate atmospheric leg to the Wastewater Neutralization Vessel (167). The AA lost in this stream represents approximately 26 percent of the overall AA loss.

The Wastewater Neutralization Vessel receives feed from the Water Flash Vessel (108A; Stream No. 12) in the Oxidation System, from the Solvent Purification Column Reflux Decanter (142; Stream No. 34) in the Solvent Purification System, and the Hydrocarbon Recovery Column Vacuum System (166). These streams comprise sulfuric acid and/or AA which should be neutralized before purging to a wastewater treatment system. The neutralization may be accomplished by feeding 25 wt % caustic material (Stream No. 3) to this vessel. For example, when caustic material comprises sodium hydroxide, sulfuric acid is converted to sodium sulfate and AA is converted to sodium acetate. The sensible heat in the warm feed streams and the heat of neutralization may be removed by recirculation through the Wastewater Neutralization Vessel Cooler (169), which is serviced by cooling tower water. The net wastewater leaving the Wastewater Neutralization Vessel is pumped (168) to a Wastewater Treatment Plant (Stream No. 47).

TABLE 2

Material Balance and Properties of Streams 1-4

| Stream Description | | Stream Number 1 Gas Oil Feed | 2 Catalyst Makeup | 3 25 wt % Caustic to Neutralization | 4 Hydrogen Peroxide Feed |
|---|---|---|---|---|---|
| Temperature | F. | 68.0 | 68.0 | 68.0 | 77.0 |
| Pressure | psia | 29.39 | 29.39 | 14.70 | 29.39 |
| Total Flow | lb-mol/hr | 335.40 | 0.01 | 6.01 | 59.18 |
| Total Flow | lb/hr | 62842.5 | 0.9 | 125.5 | 1457.3 |
| Total Flow | gpm | 149.5 | 0.0 | 0.2 | 2.3 |
| Total Flow | bpsd | 5125.8 | 0.0 | 6.8 | 77.9 |
| Mass Flow | lb/hr | | | | |
| $O_2$ | | 0.0 | 0.0 | 0.0 | 0.0 |
| $N_2$ | | 0.0 | 0.0 | 0.0 | 0.0 |

TABLE 2-continued

Material Balance and Properties of Streams 1-4

| Stream Description | | Stream Number 1 Gas Oil Feed | 2 Catalyst Makeup | 3 25 wt % Caustic to Neutralization | 4 Hydrogen Peroxide Feed |
|---|---|---|---|---|---|
| $H_2O$ | | 0.0 | 0.0 | 94.1 | 437.2 |
| $H_2O_2$ | | 0.0 | 0.0 | 0.0 | 1020.1 |
| $H_2SO_4$ | | 0.0 | 0.9 | 0.0 | 0.0 |
| Acetic Acid | | 0.0 | 0.0 | 0.0 | 0.0 |
| Aliphatics | | 41733.7 | 0.0 | 0.0 | 0.0 |
| Aromatics | | 19292.6 | 0.0 | 0.0 | 0.0 |
| Thiophenes | | 1816.1 | 0.0 | 0.0 | 0.0 |
| Sulfones | | 0.0 | 0.0 | 0.0 | 0.0 |
| Sodium Hydroxide | | 0.0 | 0.0 | 31.4 | 0.0 |
| Sodium Sulfate | | 0.0 | 0.0 | 0.0 | 0.0 |
| Sodium Acetate | | 0.0 | 0.0 | 0.0 | 0.0 |
| Mass Fraction | lb/lb | | | | |
| $O_2$ | | 0.0000 | 0.0000 | 0.0000 | 0.0000 |
| $N_2$ | | 0.0000 | 0.0000 | 0.0000 | 0.0000 |
| $H_2O$ | | 0.0000 | 0.0200 | 0.7500 | 0.3000 |
| $H_2O_2$ | | 0.0000 | 0.0000 | 0.0000 | 0.7000 |
| $H_2SO_4$ | | 0.0000 | 0.9800 | 0.0000 | 0.0000 |
| Acetic Acid | | 0.0000 | 0.0000 | 0.2500 | 0.0000 |
| Aliphatics | | 0.6641 | 0.0000 | 0.0000 | 0.0000 |
| Aromatics | | 0.3070 | 0.0000 | 0.0000 | 0.0000 |
| Thiophenes | | 0.0289 | 0.0000 | 0.0000 | 0.0000 |
| Sulfones | | 0.0000 | 0.0000 | 0.0000 | 0.0000 |
| Sodium Hydroxide | | 0.0000 | 0.0000 | 0.2500 | 0.0000 |
| Sodium Sulfate | | 0.0000 | 0.0000 | 0.0000 | 0.0000 |
| Sodium Acetate | | 0.0000 | 0.0000 | 0.0000 | 0.0000 |
| Sulfur Content | ppmw | | | | |
| Actual | | 5099.3 | 320339.5 | 0.0 | 0.0 |
| Fuel Basis | | 5099.3 | na | na | na |
| Physical Properties | | | | | |
| Density (liquid) | lb/gal | 7.00 | 14.39 | 10.59 | 10.67 |
| Density (vapor) | lb/ft3 | na | na | na | na |
| Heat Capacity | btu/lb-R | 0.467 | 0.217 | 0.820 | 0.666 |
| Viscosity | cP | 3.639 | 20.519 | | 1.032 |
| Viscosity (light phase) | cP | na | na | na | na |
| Viscosity (heavy phase) | cP | na | na | na | na |

TABLE 3

Material Balance and Properties of Streams 5-8.

| Stream Description | | Stream Number 5 First Stage Oxidizer Feed | 6 First Stage Oxidizer Effluent | 7 First Stage Light Phase | 8 First Stage Heavy Phase |
|---|---|---|---|---|---|
| Temperature | ° F. | 176.0 | 181.4 | 181.4 | 181.2 |
| Pressure | psia | 14.70 | 17.00 | 17.00 | 17.00 |
| Total Flow | lb-mol/hr | 933.94 | 939.39 | 582.59 | 351.35 |
| Total Flow | lb/hr | 96619.7 | 96619.7 | 76941.4 | 19518.3 |
| Total Flow | gpm | 218.8 | 553.3 | 179.9 | 38.5 |
| Total Flow | bpsd | 7500.1 | 18971.4 | 6167.2 | 1319.2 |
| Mass Flow | lb/hr | | | | |
| $O_2$ | | 0.0 | 160.0 | 0.0 | 0.0 |
| $N_2$ | | 0.0 | 0.0 | 0.0 | 0.0 |
| $H_2O$ | | 772.0 | 1297.9 | 139.6 | 1158.4 |
| $H_2O_2$ | | 993.0 | 0.0 | 0.0 | 0.0 |
| $H_2SO_4$ | | 156.0 | 156.0 | 0.0 | 156.0 |
| Acetic Acid | | 26754.5 | 26754.5 | 12750.3 | 14004.2 |
| Aliphatics | | 42381.8 | 42381.8 | 42070.3 | 311.5 |
| Aromatics | | 21469.5 | 21469.5 | 19625.1 | 1844.4 |
| Thiophenes | | 1816.1 | 72.6 | 58.7 | 14.0 |
| Sulfones | | 2276.7 | 4327.2 | 2297.4 | 2029.8 |
| Sodium Hydroxide | | 0.0 | 0.0 | 0.0 | 0.0 |

TABLE 3-continued

Material Balance and Properties of Streams 5-8.

| Stream Description | | Stream Number 5 First Stage Oxidizer Feed | 6 First Stage Oxidizer Effluent | 7 First Stage Light Phase | 8 First Stage Heavy Phase |
|---|---|---|---|---|---|
| Sodium Sulfate | | 0.0 | 0.0 | 0.0 | 0.0 |
| Sodium Acetate | | 0.0 | 0.0 | 0.0 | 0.0 |
| Mass Fraction | lb/lb | | | | |
| $O_2$ | | 0.0000 | 0.0017 | 0.0000 | 0.0000 |
| $N_2$ | | 0.0000 | 0.0000 | 0.0000 | 0.0000 |
| $H_2O$ | | 0.0080 | 0.0134 | 0.0018 | 0.0593 |
| $H_2O_2$ | | 0.0103 | 0.0000 | 0.0000 | 0.0000 |
| $H_2SO_4$ | | 0.0016 | 0.0016 | 0.0000 | 0.0080 |
| Acetic Acid | | 0.2769 | 0.2769 | 0.1657 | 0.7175 |
| Aliphatics | | 0.4386 | 0.4386 | 0.5468 | 0.0160 |
| Aromatics | | 0.2222 | 0.2222 | 0.2551 | 0.0945 |
| Thiophenes | | 0.0188 | 0.0008 | 0.0008 | 0.0007 |
| Sulfones | | 0.0236 | 0.0448 | 0.0299 | 0.1040 |
| Sodium Hydroxide | | 0.0000 | 0.0000 | 0.0000 | 0.0000 |
| Sodium Sulfate | | 0.0000 | 0.0000 | 0.0000 | 0.0000 |
| Sodium Acetate | | 0.0000 | 0.0000 | 0.0000 | 0.0000 |
| Sulfur Content | ppmw | | | | |
| Actual | | 7397.9 | 7397.9 | 4616.0 | 18424.9 |
| Fuel Basis | | 10520.2 | 10472.9 | 5545.0 | 85630.9 |
| Physical Properties | | | | | |
| Density (liquid) | lb/gal | 7.36 | 7.39 | 7.12 | 8.45 |
| Density (vapor) | lb/ft3 | na | na | na | na |
| Heat Capacity | btu/lb-R | 0.527 | 0.587 | 0.518 | 0.595 |
| Viscosity | cP | na | na | 0.867 | 0.544 |
| Viscosity (light phase) | cP | 0.827 | | na | na |
| Viscosity (heavy phase) | cP | 0.559 | | na | na |

TABLE 4

Material Balance and Properties of Streams 9-12

| Stream Description | | Stream Number 9 Flash Drum Vapor | 10 Recycle Acid to First Stage | 11 Recycle Acid to Second Stage | 12 Reactor Recycle Purge |
|---|---|---|---|---|---|
| Temperature | F. | 249.3 | 249.1 | 249.1 | 249.3 |
| Pressure | psia | 18.00 | 18.00 | 18.00 | 18.00 |
| Total Flow | lb-mol/hr | 247.96 | 0.00 | 102.88 | 0.52 |
| Total Flow | lb/hr | 11350.5 | 0.0 | 8127.8 | 40.8 |
| Total Flow | gpm | 8892.6 | 0.0 | 15.4 | 0.1 |
| Total Flow | bpsd | 304890.4 | 0.0 | 528.0 | 2.7 |
| Mass Flow | lb/hr | | | | |
| $O_2$ | | 0.0 | 0.0 | 0.0 | 0.0 |
| $N_2$ | | 0.0 | 0.0 | 0.0 | 0.0 |
| $H_2O$ | | 1050.3 | 0.0 | 107.6 | 0.5 |
| $H_2O_2$ | | 0.0 | 0.0 | 0.0 | 0.0 |
| $H_2SO_4$ | | 0.1 | 0.0 | 156.0 | 0.8 |
| Acetic Acid | | 10003.9 | 0.0 | 3980.3 | 20.0 |
| Aliphatics | | 69.6 | 0.0 | 240.7 | 1.2 |
| Aromatics | | 226.5 | 0.0 | 1609.8 | 8.1 |
| Thiophenes | | 0.2 | 0.0 | 13.7 | 0.1 |
| Sulfones | | 0.0 | 0.0 | 2019.6 | 10.1 |
| Sodium Hydroxide | | 0.0 | 0.0 | 0.0 | 0.0 |
| Sodium Sulfate | | 0.0 | 0.0 | 0.0 | 0.0 |
| Sodium Acetate | | 0.0 | 0.0 | 0.0 | 0.0 |
| Mass Fraction | lb/lb | | | | |
| $O_2$ | | 0.0000 | 0.0000 | 0.0000 | 0.0000 |
| $N_2$ | | 0.0000 | 0.0000 | 0.0000 | 0.0000 |
| $H_2O$ | | 0.0925 | 0.0132 | 0.0132 | 0.0132 |
| $H_2O_2$ | | 0.0000 | 0.0000 | 0.0000 | 0.0000 |
| $H_2SO_4$ | | 0.0000 | 0.0192 | 0.0192 | 0.0191 |

TABLE 4-continued

Material Balance and Properties of Streams 9-12

| Stream Description | | Stream Number 9 Flash Drum Vapor | 10 Recycle Acid to First Stage | 11 Recycle Acid to Second Stage | 12 Reactor Recycle Purge |
|---|---|---|---|---|---|
| Acetic Acid | | 0.8814 | 0.4897 | 0.4897 | 0.4898 |
| Aliphatics | | 0.0061 | 0.0296 | 0.0296 | 0.0296 |
| Aromatics | | 0.0200 | 0.1981 | 0.1981 | 0.1981 |
| Thiophenes | | 0.0000 | 0.0017 | 0.0017 | 0.0017 |
| Sulfones | | 0.0000 | 0.2485 | 0.2485 | 0.2485 |
| Sodium Hydroxide | | 0.0000 | 0.0000 | 0.0000 | 0.0000 |
| Sodium Sulfate | | 0.0000 | 0.0000 | 0.0000 | 0.0000 |
| Sodium Acetate | | 0.0000 | 0.0000 | 0.0000 | 0.0000 |
| Sulfur Content | ppmw | | | | |
| Actual | | 5.0 | 44052.1 | 44052.1 | 44022.5 |
| Fuel Basis | | 190.0 | 44052.1 | 92187.5 | 92115.6 |
| Physical Properties | | | | | |
| Density (liquid) | lb/gal | na | 8.79 | 8.79 | 8.79 |
| Density (vapor) | lb/ft3 | 0.159 | na | na | na |
| Heat Capacity | btu/lb-R | 0.966 | 0.572 | 0.572 | 0.572 |
| Viscosity | cP | 0.012 | 0.497 | 0.497 | 0.497 |
| Viscosity (light phase) | cP | na | na | na | na |
| Viscosity (heavy phase) | cP | na | na | na | na |

TABLE 5

Material Balance and Properties of Streams 13-16

| Stream Description | | Stream Number 13 Second Stage Oxidizer Feed | 14 Second Stage Oxidizer Effluent | 15 Second Stage Light Phase | 16 Second Stage Heavy Phase |
|---|---|---|---|---|---|
| Temperature | F. | 139.6 | 140.0 | 140.0 | 140.0 |
| Pressure | psia | 17.00 | 17.00 | 17.00 | 17.00 |
| Total Flow | lb-mol/hr | 744.65 | 744.65 | 514.53 | 230.12 |
| Total Flow | lb/hr | 86526.5 | 86526.5 | 73545.4 | 12981.1 |
| Total Flow | gpm | 196.0 | 196.0 | 170.4 | 24.3 |
| Total Flow | bpsd | 6719.5 | 6719.9 | 5843.9 | 834.2 |
| Mass Flow | lb/hr | | | | |
| $O_2$ | | 0.0 | 0.0 | 0.0 | 0.0 |
| $N_2$ | | 0.0 | 0.0 | 0.0 | 0.0 |
| $H_2O$ | | 684.3 | 698.7 | 58.2 | 640.4 |
| $H_2O_2$ | | 1020.1 | 993.0 | 0.0 | 993.0 |
| $H_2SO_4$ | | 156.0 | 156.0 | 0.0 | 156.0 |
| Acetic Acid | | 16730.6 | 16730.6 | 9205.7 | 7524.9 |
| Aliphatics | | 42311.0 | 42311.0 | 42179.1 | 131.9 |
| Aromatics | | 21234.9 | 21234.9 | 19976.7 | 1258.3 |
| Thiophenes | | 72.4 | 0.0 | 0.0 | 0.0 |
| Sulfones | | 4317.1 | 4402.2 | 2125.6 | 2276.6 |
| Sodium Hydroxide | | 0.0 | 0.0 | 0.0 | 0.0 |
| Sodium Sulfate | | 0.0 | 0.0 | 0.0 | 0.0 |
| Sodium Acetate | | 0.0 | 0.0 | 0.0 | 0.0 |
| Mass Fraction | lb/lb | | | | |
| $O_2$ | | 0.0000 | 0.0000 | 0.0000 | 0.0000 |
| $N_2$ | | 0.0000 | 0.0000 | 0.0000 | 0.0000 |
| $H_2O$ | | 0.0079 | 0.0081 | 0.0008 | 0.0493 |
| $H_2O_2$ | | 0.0118 | 0.0115 | 0.0000 | 0.0765 |
| $H_2SO_4$ | | 0.0018 | 0.0018 | 0.0000 | 0.0120 |
| Acetic Acid | | 0.1934 | 0.1934 | 0.1252 | 0.5797 |
| Aliphatics | | 0.4890 | 0.4890 | 0.5735 | 0.0102 |
| Aromatics | | 0.2454 | 0.2454 | 0.2716 | 0.0969 |
| Thiophenes | | 0.0008 | 0.0000 | 0.0000 | 0.0000 |
| Sulfones | | 0.0499 | 0.0509 | 0.0289 | 0.1754 |
| Sodium Hydroxide | | 0.0000 | 0.0000 | 0.0000 | 0.0000 |
| Sodium Sulfate | | 0.0000 | 0.0000 | 0.0000 | 0.0000 |
| Sodium Acetate | | 0.0000 | 0.0000 | 0.0000 | 0.0000 |
| Sulfur Content | ppmw | | | | |

TABLE 5-continued

Material Balance and Properties of Streams 13-16

| Stream Description | | Stream Number 13 Second Stage Oxidizer Feed | 14 Second Stage Oxidizer Effluent | 15 Second Stage Light Phase | 16 Second Stage Heavy Phase |
|---|---|---|---|---|---|
| Actual | | 8242.7 | 8242.7 | 4335.9 | 30376.6 |
| Fuel Basis | | 10498.4 | 10496.4 | 4960.8 | 107539.3 |
| Physical Properties | | | | | |
| Density (liquid) | lb/gal | 7.35 | 7.35 | 7.19 | 8.88 |
| Density (vapor) | lb/ft3 | na | na | na | na |
| Heat Capacity | btu/lb-R | 0.486 | 0.486 | 0.485 | 0.487 |
| Viscosity | cP | na | na | 1.278 | 0.745 |
| Viscosity (light phase) | cP | 1.235 | 1.235 | na | na |
| Viscosity (heavy phase) | cP | 0.765 | 0.762 | na | na |

TABLE 6

Material Balance and Properties of Streams 17-20

| Stream Description | | Stream Number 17 Destruct Reactor Effluent | 18 Sulfox Extraction Raffinate | 19 Sulfox Extraction Extract | 20 Wash Column Feed |
|---|---|---|---|---|---|
| Temperature | F. | 230.0 | 113.0 | 113.0 | 110.4 |
| Pressure | psia | 17.00 | 29.39 | 29.39 | 0.19 |
| Total Flow | lb-mol/hr | 514.53 | 315.22 | 1840.21 | 523.27 |
| Total Flow | lb/hr | 73545.4 | 46294.6 | 119179.4 | 75270.0 |
| Total Flow | gpm | 178.7 | 112.0 | 229.7 | 176.0 |
| Total Flow | bpsd | 6128.4 | 3839.3 | 7875.5 | 6035.4 |
| Mass Flow | lb/hr | | | | |
| $O_2$ | | 0.0 | 0.0 | 0.0 | 0.0 |
| $N_2$ | | 0.0 | 0.0 | 0.0 | 0.0 |
| $H_2O$ | | 58.2 | 1.7 | 604.4 | 16.5 |
| $H_2O_2$ | | 0.0 | 0.0 | 0.0 | 0.0 |
| $H_2SO_4$ | | 0.0 | 0.0 | 0.1 | 0.0 |
| Acetic Acid | | 9205.7 | 6315.6 | 89301.6 | 9159.8 |
| Aliphatics | | 42179.1 | 35598.5 | 8336.0 | 46985.8 |
| Aromatics | | 19976.7 | 4373.0 | 18816.1 | 19101.8 |
| Thiophenes | | 0.0 | 0.0 | 0.0 | 0.2 |
| Sulfones | | 2125.6 | 5.8 | 2121.2 | 5.9 |
| Sodium Hydroxide | | 0.0 | 0.0 | 0.0 | 0.0 |
| Sodium Sulfate | | 0.0 | 0.0 | 0.0 | 0.0 |
| Sodium Acetate | | 0.0 | 0.0 | 0.0 | 0.0 |
| Mass Fraction | lb/lb | | | | |
| $O_2$ | | 0.0000 | 0.0000 | 0.0000 | 0.0000 |
| $N_2$ | | 0.0000 | 0.0000 | 0.0000 | 0.0000 |
| $H_2O$ | | 0.0008 | 0.0000 | 0.0051 | 0.0002 |
| $H_2O_2$ | | 0.0000 | 0.0000 | 0.0000 | 0.0000 |
| $H_2SO_4$ | | 0.0000 | 0.0000 | 0.0000 | 0.0000 |
| Acetic Acid | | 0.1252 | 0.1364 | 0.7493 | 0.1217 |
| Aliphatics | | 0.5735 | 0.7690 | 0.0699 | 0.6242 |
| Aromatics | | 0.2716 | 0.0945 | 0.1579 | 0.2538 |
| Thiophenes | | 0.0000 | 0.0000 | 0.0000 | 0.0000 |
| Sulfones | | 0.0289 | 0.0001 | 0.0178 | 0.0001 |
| Sodium Hydroxide | | 0.0000 | 0.0000 | 0.0000 | 0.0000 |
| Sodium Sulfate | | 0.0000 | 0.0000 | 0.0000 | 0.0000 |
| Sodium Acetate | | 0.0000 | 0.0000 | 0.0000 | 0.0000 |
| Sulfur Content | ppmw | | | | |
| Actual | | 4335.9 | 18.9 | 2670.5 | 12.2 |
| Fuel Basis | | 4960.8 | 21.9 | 10872.3 | 13.9 |
| Physical Properties | | | | | |
| Density (liquid) | lb/gal | 6.85 | 6.88 | 8.64 | 7.12 |
| Density (vapor) | lb/ft3 | na | na | na | na |
| Heat Capacity | btu/lb-R | 0.536 | 0.491 | 0.435 | 0.473 |
| Viscosity | cP | 0.677 | 1.447 | 0.922 | 1.565 |

TABLE 6-continued

| Material Balance and Properties of Streams 17-20 | | | | | |
|---|---|---|---|---|---|
| | | Stream Number | | | |
| Stream Description | | 17 Destruct Reactor Effluent | 18 Sulfox Extraction Raffinate | 19 Sulfox Extraction Extract | 20 Wash Column Feed |
| Viscosity (light phase) | cP | na | na | na | na |
| Viscosity (heavy phase) | cP | na | na | na | na |

TABLE 7

| Material Balance and Properties of Streams 21-24 | | | | | |
|---|---|---|---|---|---|
| | | Stream Number | | | |
| Stream Description | | 21 Wash Column Extract | 22 Gas Oil to Polishing | 23 Product Gas Oil to Storage | 24 Spent Acetic Acid |
| Temperature | F. | 113.0 | 113.0 | 113.0 | 110.7 |
| Pressure | psia | 14.70 | 14.70 | 14.70 | 73.48 |
| Total Flow | lb-mol/hr | 384.85 | 363.49 | 270.32 | 152.33 |
| Total Flow | lb/hr | 12588.8 | 66437.9 | 56414.6 | 10023.3 |
| Total Flow | gpm | 25.8 | 164.1 | 139.4 | 20.2 |
| Total Flow | bpsd | 885.4 | 5624.7 | 4779.9 | 691.5 |
| Mass Flow | lb/hr | | | | |
| $O_2$ | | 0.0 | 0.0 | 0.0 | 0.0 |
| $N_2$ | | 0.0 | 0.0 | 0.0 | 0.0 |
| $H_2O$ | | 3701.1 | 16.5 | 0.0 | 53.2 |
| $H_2O_2$ | | 0.0 | 0.0 | 0.0 | 0.0 |
| $H_2SO_4$ | | 0.0 | 0.0 | 0.0 | 0.0 |
| Acetic Acid | | 8824.5 | 388.7 | 0.0 | 7459.9 |
| Aliphatics | | 2.3 | 46984.8 | 40143.7 | 1742.6 |
| Aromatics | | 59.2 | 19043.6 | 16270.9 | 762.8 |
| Thiophenes | | 0.0 | 0.1 | 0.0 | 0.0 |
| Sulfones | | 1.7 | 4.2 | 0.0 | 4.7 |
| Sodium Hydroxide | | 0.0 | 0.0 | 0.0 | 0.0 |
| Sodium Sulfate | | 0.0 | 0.0 | 0.0 | 0.0 |
| Sodium Acetate | | 0.0 | 0.0 | 0.0 | 0.0 |
| Mass Fraction | lb/lb | | | | |
| $O_2$ | | 0.0000 | 0.0000 | 0.0000 | 0.0000 |
| $N_2$ | | 0.0000 | 0.0000 | 0.0000 | 0.0000 |
| $H_2O$ | | 0.2940 | 0.0002 | 0.0000 | 0.0053 |
| $H_2O_2$ | | 0.0000 | 0.0000 | 0.0000 | 0.0000 |
| $H_2SO_4$ | | 0.0000 | 0.0000 | 0.0000 | 0.0000 |
| Acetic Acid | | 0.7010 | 0.0058 | 0.0000 | 0.7443 |
| Aliphatics | | 0.0002 | 0.7072 | 0.7116 | 0.1739 |
| Aromatics | | 0.0047 | 0.2866 | 0.2884 | 0.0761 |
| Thiophenes | | 0.0000 | 0.0000 | 0.0000 | 0.0000 |
| Sulfones | | 0.0001 | 0.0001 | 0.0000 | 0.0005 |
| Sodium Hydroxide | | 0.0000 | 0.0000 | 0.0000 | 0.0000 |
| Sodium Sulfate | | 0.0000 | 0.0000 | 0.0000 | 0.0000 |
| Sodium Acetate | | 0.0000 | 0.0000 | 0.0000 | 0.0000 |
| Sulfur Content | ppmw | | | | |
| Actual | | 21.2 | 9.8 | 0.0 | 71.2 |
| Fuel Basis | | 4220.0 | 9.9 | 0.0 | 284.3 |
| Physical Properties | | | | | |
| Density (liquid) | lb/gal | 8.12 | 6.74 | 6.74 | 8.28 |
| Density (vapor) | lb/ft3 | na | na | na | na |
| Heat Capacity | btu/lb-R | 0.697 | 0.470 | 0.470 | 0.454 |
| Viscosity | cP | 0.701 | 1.981 | 1.981 | 0.923 |
| Viscosity (light phase) | cP | na | na | na | na |
| Viscosity (heavy phase) | cP | na | na | na | na |

TABLE 8

Material Balance and Properties of Streams 25-28.

| Stream Description | | Stream Number 25 Spent Gas Oil | 26 Feed to Solvent Recovery Flash | 27 Vapor from Solvent Recovery Flash | 28 Liquid from Solvent Recovery Flash |
|---|---|---|---|---|---|
| Temperature | F. | 105.7 | 185.3 | 342.9 | 342.9 |
| Pressure | psia | 73.48 | 44.09 | 44.09 | 44.09 |
| Total Flow | lb-mol/hr | 82.47 | 1992.54 | 1771.74 | 220.80 |
| Total Flow | lb/hr | 9613.8 | 129202.7 | 100021.1 | 29181.5 |
| Total Flow | gpm | 21.6 | 262.4 | 29118.3 | 66.5 |
| Total Flow | bpsd | 739.0 | 8996.4 | 998340.1 | 2281.3 |
| Mass Flow | lb/hr | | | | |
| $O_2$ | | 0.0 | 0.0 | 0.0 | 0.0 |
| $N_2$ | | 0.0 | 0.0 | 0.0 | 0.0 |
| $H_2O$ | | 12.0 | 657.6 | 650.0 | 7.6 |
| $H_2O_2$ | | 0.0 | 0.0 | 0.0 | 0.0 |
| $H_2SO_4$ | | 0.0 | 0.1 | 0.0 | 0.1 |
| Acetic Acid | | 2353.1 | 96761.5 | 92403.0 | 4358.5 |
| Aliphatics | | 5175.5 | 10078.6 | 2508.6 | 7570.0 |
| Aromatics | | 2073.0 | 19578.9 | 4459.3 | 15119.6 |
| Thiophenes | | 0.0 | 0.1 | 0.0 | 0.1 |
| Sulfones | | 0.1 | 2126.0 | 0.2 | 2125.7 |
| Sodium Hydroxide | | 0.0 | 0.0 | 0.0 | 0.0 |
| Sodium Sulfate | | 0.0 | 0.0 | 0.0 | 0.0 |
| Sodium Acetate | | 0.0 | 0.0 | 0.0 | 0.0 |
| Mass Fraction | lb/lb | | | | |
| $O_2$ | | 0.0000 | 0.0000 | 0.0000 | 0.0000 |
| $N_2$ | | 0.0000 | 0.0000 | 0.0000 | 0.0000 |
| $H_2O$ | | 0.0013 | 0.0051 | 0.0065 | 0.0003 |
| $H_2O_2$ | | 0.0000 | 0.0000 | 0.0000 | 0.0000 |
| $H_2SO_4$ | | 0.0000 | 0.0000 | 0.0000 | 0.0000 |
| Acetic Acid | | 0.2448 | 0.7489 | 0.9238 | 0.1494 |
| Aliphatics | | 0.5383 | 0.0780 | 0.0251 | 0.2594 |
| Aromatics | | 0.2156 | 0.1515 | 0.0446 | 0.5181 |
| Thiophenes | | 0.0000 | 0.0000 | 0.0000 | 0.0000 |
| Sulfones | | 0.0000 | 0.0165 | 0.0000 | 0.0728 |
| Sodium Hydroxide | | 0.0000 | 0.0000 | 0.0000 | 0.0000 |
| Sodium Sulfate | | 0.0000 | 0.0000 | 0.0000 | 0.0000 |
| Sodium Acetate | | 0.0000 | 0.0000 | 0.0000 | 0.0000 |
| Sulfur Content | ppmw | | | | |
| Actual | | 2.1 | 2468.8 | 0.4 | 10929.6 |
| Fuel Basis | | 2.8 | 10036.1 | 5.4 | 12852.7 |
| Physical Properties | | | | | |
| Density (liquid) | lb/gal | 7.43 | 8.20 | na | 7.30 |
| Density (vapor) | lb/ft3 | na | na | 0.428 | na |
| Heat Capacity | btu/lb-R | 0.477 | 0.491 | 1.050 | 0.541 |
| Viscosity | cP | 1.353 | 0.567 | 0.013 | 0.435 |
| Viscosity (light phase) | cP | na | na | na | na |
| Viscosity (heavy phase) | cP | na | na | na | na |

TABLE 9

Material Balance and Properties of Streams 29-32.

| Stream Description | | Stream Number 29 Recovered Acid to First Stage | 30 Recovered Acid to Sulfox Extractor | 31 Recovered Acid to Purification | 32 Ovhd Vapor from Purification Column |
|---|---|---|---|---|---|
| Temperature | F. | 299.9 | 299.9 | 299.9 | 222.3 |
| Pressure | psia | 44.09 | 44.09 | 44.09 | 18.00 |
| Total Flow | lb-mol/hr | 368.41 | 1181.35 | 295.34 | 1468.03 |
| Total Flow | lb/hr | 20796.0 | 66684.0 | 16671.0 | 25355.6 |
| Total Flow | gpm | 46.7 | 149.8 | 37.5 | 67112.5 |
| Total Flow | bpsd | 1601.8 | 5136.1 | 1284.0 | 2300998.9 |

TABLE 9-continued

Material Balance and Properties of Streams 29-32.

| Stream Description | | Stream Number 29 Recovered Acid to First Stage | 30 Recovered Acid to Sulfox Extractor | 31 Recovered Acid to Purification | 32 Ovhd Vapor from Purification Column |
|---|---|---|---|---|---|
| Mass Flow | lb/hr | | | | |
| $O_2$ | | 0.0 | 0.0 | 0.0 | 0.0 |
| $N_2$ | | 0.0 | 0.0 | 0.0 | 0.0 |
| $H_2O$ | | 131.5 | 421.6 | 105.4 | 23994.6 |
| $H_2O_2$ | | 0.0 | 0.0 | 0.0 | 0.0 |
| $H_2SO_4$ | | 0.0 | 0.0 | 0.0 | 0.0 |
| Acetic Acid | | 19229.7 | 61661.7 | 15415.4 | 347.8 |
| Aliphatics | | 516.2 | 1655.3 | 413.8 | 354.4 |
| Aromatics | | 918.5 | 2945.2 | 736.3 | 658.8 |
| Thiophenes | | 0.0 | 0.0 | 0.0 | 0.1 |
| Sulfones | | 0.0 | 0.1 | 0.0 | 0.0 |
| Sodium Hydroxide | | 0.0 | 0.0 | 0.0 | 0.0 |
| Sodium Sulfate | | 0.0 | 0.0 | 0.0 | 0.0 |
| Sodium Acetate | | 0.0 | 0.0 | 0.0 | 0.0 |
| Mass Fraction | lb/lb | | | | |
| $O_2$ | | 0.0000 | 0.0000 | 0.0000 | 0.0000 |
| $N_2$ | | 0.0000 | 0.0000 | 0.0000 | 0.0000 |
| $H_2O$ | | 0.0063 | 0.0063 | 0.0063 | 0.9463 |
| $H_2O_2$ | | 0.0000 | 0.0000 | 0.0000 | 0.0000 |
| $H_2SO_4$ | | 0.0000 | 0.0000 | 0.0000 | 0.0000 |
| Acetic Acid | | 0.9247 | 0.9247 | 0.9247 | 0.0137 |
| Aliphatics | | 0.0248 | 0.0248 | 0.0248 | 0.0140 |
| Aromatics | | 0.0442 | 0.0442 | 0.0442 | 0.0260 |
| Thiophenes | | 0.0000 | 0.0000 | 0.0000 | 0.0000 |
| Sulfones | | 0.0000 | 0.0000 | 0.0000 | 0.0000 |
| Sodium Hydroxide | | 0.0000 | 0.0000 | 0.0000 | 0.0000 |
| Sodium Sulfate | | 0.0000 | 0.0000 | 0.0000 | 0.0000 |
| Sodium Acetate | | 0.0000 | 0.0000 | 0.0000 | 0.0000 |
| Sulfur Content | ppmw | | | | |
| Actual | | 0.4 | 0.4 | 0.4 | 0.0 |
| Fuel Basis | | 5.2 | 5.2 | 5.2 | 0.0 |
| Physical Properties | | | | | |
| Density (liquid) | lb/gal | 7.41 | 7.41 | 7.41 | na |
| Density (vapor) | lb/ft3 | na | na | na | 0.047 |
| Heat Capacity | btu/lb-R | 0.653 | 0.653 | 0.653 | 0.522 |
| Viscosity | cP | 0.299 | 0.299 | 0.299 | 0.013 |
| Viscosity (light phase) | cP | na | na | na | na |
| Viscosity (heavy phase) | cP | na | na | na | na |

TABLE 10

Material Balance and Properties of Streams 33-36.

| Stream Description | | Stream Number 33 Reflux to Purification Column | 34 Water Purge from Purification Column | 35 Solvent Water to Wash Column | 36 Distillate from Purification |
|---|---|---|---|---|---|
| Temperature | F. | 206.8 | 113.0 | 113.0 | 206.8 |
| Pressure | psia | 18.00 | 18.00 | 18.00 | 18.00 |
| Total Flow | lb-mol/hr | 1174.42 | 59.51 | 225.07 | 9.02 |
| Total Flow | lb/hr | 19603.6 | 993.3 | 3756.9 | 1001.7 |
| Total Flow | gpm | 42.6 | 2.0 | 7.7 | 2.6 |
| Total Flow | bpsd | 1460.4 | 69.9 | 264.3 | 90.3 |
| Mass Flow | lb/hr | | | | |
| $O_2$ | | 0.0 | 0.0 | 0.0 | 0.0 |
| $N_2$ | | 0.0 | 0.0 | 0.0 | 0.0 |
| $H_2O$ | | 19312.1 | 978.6 | 3701.1 | 2.8 |
| $H_2O_2$ | | 0.0 | 0.0 | 0.0 | 0.0 |
| $H_2SO_4$ | | 0.0 | 0.0 | 0.0 | 0.0 |
| Acetic Acid | | 279.1 | 14.1 | 53.5 | 1.1 |
| Aliphatics | | 6.8 | 0.3 | 1.3 | 345.9 |

TABLE 10-continued

Material Balance and Properties of Streams 33-36.

| Stream Description | | Stream Number 33 Reflux to Purification Column | 34 Water Purge from Purification Column | 35 Solvent Water to Wash Column | 36 Distillate from Purification |
|---|---|---|---|---|---|
| Aromatics | | 5.6 | 0.3 | 1.1 | 651.8 |
| Thiophenes | | 0.0 | 0.0 | 0.0 | 0.1 |
| Sulfones | | 0.0 | 0.0 | 0.0 | 0.0 |
| Sodium Hydroxide | | 0.0 | 0.0 | 0.0 | 0.0 |
| Sodium Sulfate | | 0.0 | 0.0 | 0.0 | 0.0 |
| Sodium Acetate | | 0.0 | 0.0 | 0.0 | 0.0 |
| Mass Fraction | lb/lb | | | | |
| $O_2$ | | 0.0000 | 0.0000 | 0.0000 | 0.0000 |
| $N_2$ | | 0.0000 | 0.0000 | 0.0000 | 0.0000 |
| $H_2O$ | | 0.9851 | 0.9851 | 0.9851 | 0.0028 |
| $H_2O_2$ | | 0.0000 | 0.0000 | 0.0000 | 0.0000 |
| $H_2SO_4$ | | 0.0000 | 0.0000 | 0.0000 | 0.0000 |
| Acetic Acid | | 0.0142 | 0.0142 | 0.0142 | 0.0011 |
| Aliphatics | | 0.0003 | 0.0003 | 0.0003 | 0.3453 |
| Aromatics | | 0.0003 | 0.0003 | 0.0003 | 0.6507 |
| Thiophenes | | 0.0000 | 0.0000 | 0.0000 | 0.0001 |
| Sulfones | | 0.0000 | 0.0000 | 0.0000 | 0.0000 |
| Sodium Hydroxide | | 0.0000 | 0.0000 | 0.0000 | 0.0000 |
| Sodium Sulfate | | 0.0000 | 0.0000 | 0.0000 | 0.0000 |
| Sodium Acetate | | 0.0000 | 0.0000 | 0.0000 | 0.0000 |
| Sulfur Content | ppmw | | | | |
| Actual | | 0.0 | 0.0 | 0.0 | 10.5 |
| Fuel Basis | | 5.6 | 5.6 | 5.6 | 10.5 |
| Physical Properties | | | | | |
| Density (liquid) | lb/gal | 7.67 | 8.12 | 8.12 | 6.33 |
| Density (vapor) | lb/ft3 | na | na | na | na |
| Heat Capacity | btu/lb-R | 0.987 | 0.926 | 0.926 | 0.520 |
| Viscosity | cP | 0.289 | 0.612 | 0.612 | 0.361 |
| Viscosity (light phase) | cP | na | na | na | na |
| Viscosity (heavy phase) | cP | na | na | na | na |

TABLE 11

Material Balance and Properties of Streams 37-40.

| Stream Description | | Stream Number 37 Acetic Acid to Reboiler | 38 Purified Acid to Sulfox Extraction | 39 Purified Acid to Storage | 40 Vapor Distillate Acid Rec Column |
|---|---|---|---|---|---|
| Temperature | F. | 255.1 | 255.1 | 255.1 | 255.9 |
| Pressure | psia | 44.09 | 44.09 | 18.00 | 18.00 |
| Total Flow | lb-mol/hr | 6371.22 | 459.54 | 175.00 | 108.68 |
| Total Flow | lb/hr | 350000.0 | 25244.6 | 9613.8 | 6122.4 |
| Total Flow | gpm | 745.9 | 53.8 | 20.5 | 3447.4 |
| Total Flow | bpsd | 25572.6 | 1844.5 | 704.0 | 118198.0 |
| Mass Flow | lb/hr | | | | |
| $O_2$ | | 0.0 | 0.0 | 0.0 | 0.0 |
| $N_2$ | | 0.0 | 0.0 | 0.0 | 0.0 |
| $H_2O$ | | 1749.9 | 126.2 | 48.1 | 11.4 |
| $H_2O_2$ | | 0.0 | 0.0 | 0.0 | 0.0 |
| $H_2SO_4$ | | 0.9 | 0.1 | 0.0 | 0.0 |
| Acetic Acid | | 343139.3 | 24749.8 | 9425.3 | 5784.8 |
| Aliphatics | | 1387.7 | 100.1 | 38.1 | 115.1 |
| Aromatics | | 3703.3 | 267.1 | 101.7 | 211.2 |
| Thiophenes | | 1.0 | 0.1 | 0.0 | 0.0 |
| Sulfones | | 17.8 | 1.3 | 0.5 | 0.0 |
| Sodium Hydroxide | | 0.0 | 0.0 | 0.0 | 0.0 |
| Sodium Sulfate | | 0.0 | 0.0 | 0.0 | 0.0 |
| Sodium Acetate | | 0.0 | 0.0 | 0.0 | 0.0 |
| Mass Fraction | lb/lb | | | | |
| $O_2$ | | 0.0000 | 0.0000 | 0.0000 | 0.0000 |
| $N_2$ | | 0.0000 | 0.0000 | 0.0000 | 0.0000 |

TABLE 11-continued

Material Balance and Properties of Streams 37-40.

| Stream Description | | Stream Number 37 Acetic Acid to Reboiler | 38 Purified Acid to Sulfox Extraction | 39 Purified Acid to Storage | 40 Vapor Distillate Acid Rec Column |
|---|---|---|---|---|---|
| $H_2O$ | | 0.0050 | 0.0050 | 0.0050 | 0.0019 |
| $H_2O_2$ | | 0.0000 | 0.0000 | 0.0000 | 0.0000 |
| $H_2SO_4$ | | 0.0000 | 0.0000 | 0.0000 | 0.0000 |
| Acetic Acid | | 0.9804 | 0.9804 | 0.9804 | 0.9448 |
| Aliphatics | | 0.0040 | 0.0040 | 0.0040 | 0.0188 |
| Aromatics | | 0.0106 | 0.0106 | 0.0106 | 0.0345 |
| Thiophenes | | 0.0000 | 0.0000 | 0.0000 | 0.0000 |
| Sulfones | | 0.0001 | 0.0001 | 0.0001 | 0.0000 |
| Sodium Hydroxide | | 0.0000 | 0.0000 | 0.0000 | 0.0000 |
| Sodium Sulfate | | 0.0000 | 0.0000 | 0.0000 | 0.0000 |
| Sodium Acetate | | 0.0000 | 0.0000 | 0.0000 | 0.0000 |
| Sulfur Content | ppmw | | | | |
| Actual | | 9.1 | 9.1 | 9.1 | 0.0 |
| Fuel Basis | | 626.2 | 626.2 | 626.2 | 0.0 |
| Physical Properties | | | | | |
| Density (liquid) | lb/gal | 7.81 | 7.81 | 7.80 | na |
| Density (vapor) | lb/ft3 | na | na | na | 0.221 |
| Heat Capacity | btu/lb-R | 0.555 | 0.555 | 0.559 | 0.959 |
| Viscosity | cP | 0.372 | 0.372 | 0.367 | 0.012 |
| Viscosity (light phase) | cP | na | na | na | na |
| Viscosity (heavy phase) | cP | na | na | na | na |

TABLE 12

Material Balance and Properties of Streams 41-44.

| Stream Description | | Stream Number 41 Reflux to Acid Rec Column | 42 Rec Acid from Acid Rec Column | 43 Bottoms from Acid Rec Column | 44 Ovhd Vapor from Hyd Rec Column |
|---|---|---|---|---|---|
| Temperature | F. | 253.1 | 253.1 | 396.5 | 294.1 |
| Pressure | psia | 18.00 | 18.00 | 18.00 | 0.19 |
| Total Flow | lb-mol/hr | 36.23 | 72.45 | 148.35 | 134.78 |
| Total Flow | lb/hr | 2040.8 | 4081.6 | 25099.9 | 21140.8 |
| Total Flow | gpm | 4.4 | 8.8 | 60.6 | 643009.1 |
| Total Flow | bpsd | 150.3 | 300.6 | 2078.7 | 22046027.1 |
| Mass Flow | lb/hr | | | | |
| $O_2$ | | 0.0 | 0.0 | 0.0 | 3.0 |
| $N_2$ | | 0.0 | 0.0 | 0.0 | 10.0 |
| $H_2O$ | | 3.8 | 7.6 | 0.0 | 0.0 |
| $H_2O_2$ | | 0.0 | 0.0 | 0.0 | 0.0 |
| $H_2SO_4$ | | 0.0 | 0.0 | 0.1 | 0.0 |
| Acetic Acid | | 1928.3 | 3856.5 | 502.0 | 575.5 |
| Aliphatics | | 38.4 | 76.7 | 7493.3 | 6746.8 |
| Aromatics | | 70.4 | 140.8 | 14978.8 | 13805.5 |
| Thiophenes | | 0.0 | 0.0 | 0.1 | 0.0 |
| Sulfones | | 0.0 | 0.0 | 2125.7 | 0.0 |
| Sodium Hydroxide | | 0.0 | 0.0 | 0.0 | 0.0 |
| Sodium Sulfate | | 0.0 | 0.0 | 0.0 | 0.0 |
| Sodium Acetate | | 0.0 | 0.0 | 0.0 | 0.0 |
| Mass Fraction | lb/lb | | | | |
| $O_2$ | | 0.0000 | 0.0000 | 0.0000 | 0.0001 |
| $N_2$ | | 0.0000 | 0.0000 | 0.0000 | 0.0005 |
| $H_2O$ | | 0.0019 | 0.0019 | 0.0000 | 0.0000 |
| $H_2O_2$ | | 0.0000 | 0.0000 | 0.0000 | 0.0000 |
| $H_2SO_4$ | | 0.0000 | 0.0000 | 0.0000 | 0.0000 |
| Acetic Acid | | 0.9448 | 0.9448 | 0.0200 | 0.0272 |
| Aliphatics | | 0.0188 | 0.0188 | 0.2985 | 0.3191 |
| Aromatics | | 0.0345 | 0.0345 | 0.5968 | 0.6530 |
| Thiophenes | | 0.0000 | 0.0000 | 0.0000 | 0.0000 |
| Sulfones | | 0.0000 | 0.0000 | 0.0847 | 0.0000 |
| Sodium Hydroxide | | 0.0000 | 0.0000 | 0.0000 | 0.0000 |

TABLE 12-continued

Material Balance and Properties of Streams 41-44.

| Stream Description | | Stream Number 41 Reflux to Acid Rec Column | 42 Rec Acid from Acid Rec Column | 43 Bottoms from Acid Rec Column | 44 Ovhd Vapor from Hyd Rec Column |
|---|---|---|---|---|---|
| Sodium Sulfate | | 0.0000 | 0.0000 | 0.0000 | 0.0000 |
| Sodium Acetate | | 0.0000 | 0.0000 | 0.0000 | 0.0000 |
| Sulfur Content | ppmw | | | | |
| Actual | | 0.0 | 0.0 | 12706.9 | 0.7 |
| Fuel Basis | | 0.0 | 0.0 | 12966.3 | 0.7 |
| Physical Properties | | | | | |
| Density (liquid) | lb/gal | 7.84 | 7.75 | 6.89 | na |
| Density (vapor) | lb/ft3 | na | na | na | 0.00410 |
| Heat Capacity | btu/lb-R | 0.512 | 0.524 | 0.550 | 0.428 |
| Viscosity | cP | 0.390 | 0.369 | 0.456 | 0.007 |
| Viscosity (light phase) | cP | na | na | na | na |
| Viscosity (heavy phase) | cP | na | na | na | na |

TABLE 13

Material Balance and Properties of Streams 45-48.

| Stream Description | | Stream Number 45 Vapor to Vacuum System | 46 Offgas to Thermal Oxidizer | 47 Wastewater to Treatment Plant | 48 Reflux to Hyd Rec Column |
|---|---|---|---|---|---|
| Temperature | F. | 20.0 | 113.0 | 115.5 | 112.4 |
| Pressure | psia | 0.19 | 17.40 | 17.40 | 0.19 |
| Total Flow | lb-mol/hr | 0.73 | 0.50 | 86.20 | 17.48 |
| Total Flow | lb/hr | 27.7 | 14.2 | 1487.8 | 2753.1 |
| Total Flow | gpm | 1927.6 | 20.2 | 2.8 | 6.0 |
| Total Flow | bpsd | 66090.5 | 693.1 | 96.9 | 205.4 |
| Mass Flow | lb/hr | | | | |
| $O_2$ | | 3.0 | 2.6 | 0.0 | 0.0 |
| $N_2$ | | 9.9 | 9.1 | 0.0 | 0.0 |
| $H_2O$ | | 0.0 | 0.7 | 1402.6 | 0.0 |
| $H_2O_2$ | | 0.0 | 0.0 | 0.0 | 0.0 |
| $H_2SO_4$ | | 0.0 | 0.0 | 0.0 | 0.0 |
| Acetic Acid | | 12.0 | 0.0 | 0.0 | 73.5 |
| Aliphatics | | 1.3 | 0.9 | 2.0 | 879.6 |
| Aromatics | | 1.4 | 0.9 | 8.9 | 1800.0 |
| Thiophenes | | 0.0 | 0.0 | 0.1 | 0.0 |
| Sulfones | | 0.0 | 0.0 | 10.1 | 0.0 |
| Sodium Hydroxide | | 0.0 | 0.0 | 0.0 | 0.0 |
| Sodium Sulfate | | 0.0 | 0.0 | 1.1 | 0.0 |
| Sodium Acetate | | 0.0 | 0.0 | 63.0 | 0.0 |
| Mass Fraction | lb/lb | | | | |
| $O_2$ | | 0.1084 | 0.1817 | 0.0000 | 0.0000 |
| $N_2$ | | 0.3586 | 0.6427 | 0.0000 | 0.0000 |
| $H_2O$ | | 0.0000 | 0.0466 | 0.9427 | 0.0000 |
| $H_2O_2$ | | 0.0000 | 0.0000 | 0.0000 | 0.0000 |
| $H_2SO_4$ | | 0.0000 | 0.0000 | 0.0000 | 0.0000 |
| Acetic Acid | | 0.4338 | 0.0008 | 0.0000 | 0.0267 |
| Aliphatics | | 0.0484 | 0.0638 | 0.0013 | 0.3195 |
| Aromatics | | 0.0507 | 0.0645 | 0.0060 | 0.6538 |
| Thiophenes | | 0.0000 | 0.0000 | 0.0000 | 0.0000 |
| Sulfones | | 0.0000 | 0.0000 | 0.0068 | 0.0000 |
| Sodium Hydroxide | | 0.0000 | 0.0000 | 0.0000 | 0.0000 |
| Sodium Sulfate | | 0.0000 | 0.0000 | 0.0008 | 0.0000 |
| Sodium Acetate | | 0.0000 | 0.0000 | 0.0423 | 0.0000 |
| Sulfur Content | ppmw | | | | |
| Actual | | 0.0 | 0.0 | 1208.4 | 0.7 |
| Fuel Basis | | 0.0 | 0.0 | 85330.7 | 0.7 |

TABLE 13-continued

Material Balance and Properties of Streams 45-48.

| Stream Description | | Stream Number 45 Vapor to Vacuum System | 46 Offgas to Thermal Oxidizer | 47 Wastewater to Treatment Plant | 48 Reflux to Hyd Rec Column |
|---|---|---|---|---|---|
| Physical Properties | | | | | |
| Density (liquid) | lb/gal | na | na | 8.11 | 7.66 |
| Density (vapor) | lb/ft3 | 0.00179 | 0.087 | na | na |
| Heat Capacity | btu/lb-R | 0.427 | 0.268 | 0.922 | 0.417 |
| Viscosity | cP | 0.013 | 0.018 | na | 2.177 |
| Viscosity (light phase) | cP | na | na | 0.599 | na |
| Viscosity (heavy phase) | cP | na | na | 2.706 | na |

TABLE 14

Material Balance and Properties of Streams 49-50.

| Stream Description | | Stream Number 49 Hyd Rec Distillate Product | 50 Byproduct Extract to Storage |
|---|---|---|---|
| Temperature | F. | 112.4 | 131.0 |
| Pressure | psia | 0.19 | 17.00 |
| Total Flow | lb-mol/hr | 116.56 | 31.54 |
| Total Flow | lb/hr | 18360.0 | 6725.3 |
| Total Flow | gpm | 39.9 | 12.8 |
| Total Flow | bpsd | 1369.5 | 439.3 |
| Mass Flow | lb/hr | | |
| $O_2$ | | 0.0 | 0.0 |
| $N_2$ | | 0.1 | 0.0 |
| $H_2O$ | | 0.0 | 0.0 |
| $H_2O_2$ | | 0.0 | 0.0 |
| $H_2SO_4$ | | 0.0 | 0.1 |
| Acetic Acid | | 490.0 | 0.0 |
| Aliphatics | | 5865.8 | 1626.1 |
| Aromatics | | 12004.0 | 2973.3 |
| Thiophenes | | 0.0 | 0.0 |
| Sulfones | | 0.0 | 2125.7 |
| Sodium Hydroxide | | 0.0 | 0.0 |
| Sodium Sulfate | | 0.0 | 0.0 |
| Sodium Acetate | | 0.0 | 0.0 |
| Mass Fraction | lb/lb | | |
| $O_2$ | | 0.0000 | 0.0000 |
| $N_2$ | | 0.0000 | 0.0000 |
| $H_2O$ | | 0.0000 | 0.0000 |
| $H_2O_2$ | | 0.0000 | 0.0000 |
| $H_2SO_4$ | | 0.0000 | 0.0000 |
| Acetic Acid | | 0.0267 | 0.0000 |
| Aliphatics | | 0.3195 | 0.2418 |
| Aromatics | | 0.6538 | 0.4421 |
| Thiophenes | | 0.0000 | 0.0000 |
| Sulfones | | 0.0000 | 0.3161 |
| Sodium Hydroxide | | 0.0000 | 0.0000 |
| Sodium Sulfate | | 0.0000 | 0.0000 |
| Sodium Acetate | | 0.0000 | 0.0000 |
| Sulfur Content | ppmw | | |
| Actual | | 0.7 | 47422.9 |
| Fuel Basis | | 0.7 | 47423.4 |
| Physical Properties | | | |
| Density (liquid) | lb/gal | 7.66 | 8.75 |
| Density (vapor) | lb/ft3 | na | na |
| Heat Capacity | btu/lb-R | 0.417 | 0.343 |
| Viscosity | cP | 2.177 | 6.093 |
| Viscosity (light phase) | cP | na | na |

TABLE 14-continued

Material Balance and Properties of Streams 49-50.

| Stream Description | | Stream Number 49 Hyd Rec Distillate Product | 50 Byproduct Extract to Storage |
|---|---|---|---|
| Viscosity (heavy phase) | cP | na | na |

DETAILED EQUIPMENT DESCRIPTION

Thus far, the bulk of the disclosure is directed toward the process and its generalized unit operations. At this point a discussion of the specific equipment is warranted. These equipment details can be used in a specific embodiment of the inventive process. They are based on a U.S. Gulf coast facility designed to process 5100 bbls/day of light atmospheric gas oil at a sulfur content in the feed of about 5100 ppmw, and produce a product gas oil with a sulfur content of about 10 ppmw.

Reactors

In the present design, there are three reactors in the invention process: the First Stage Oxidizer (100), the Second Stage Oxidizer (104), and the Destruct Reactor (112).

The simulated process described herein employed a mechanically agitated contactor for the First Stage Oxidizer. Normally, this type of contactor is used in countercurrent liquid-liquid extraction. This device may be preferably utilized as a co-current upflow liquid-liquid contactor. With this flow pattern, this device mimics the effects of a plug flow reactor with minimal back mixing. The agitation enhances mass transfer by creating dispersed heavy phase droplets within the continuous light phase. In addition, the agitation minimizes the difference in the velocity of the phases in order to give approximately equal residence time for each phase.

A pilot scale mechanically agitated contactor achieved approximately 96 percent conversion of the sulfur containing compounds in the gas oil. The volume of the commercial mechanically agitated contactor is based on a 20-minute residence time used in the pilot process and the dimensions were scaled according to the hydraulic capacity of the test apparatus.

It should be noted, however, that utilizing a mechanically agitated contactor for the First Stage Oxidizer is a very expensive option. In addition, this apparatus is generally speaking unattractive to operating personnel due its mechanical nature and probable need for intensive maintenance. It is conceivable that this apparatus may be replaced with a less expensive type of column that does not have moving parts (100B, FIG. 8). Also see concepts under Improved Oxidation Schemes.

The Second Stage Oxidizer (104A) is a pipe reactor, equipped with static mixer elements. The volume of the reactor is based on the 10-minute residence time used in the laboratory experiments. The diameter of the pipe is based on the minimum velocity necessary for creating coarse heavy phase droplets that are dispersed in the continuous light phase. Also see concepts under Improved Oxidation Schemes.

For the Destruct Reactor (111), a continuous stirred vessel was chosen. The operating temperature is about 230° F. (110° C.). During steady state operation, interchangers transfer sufficient heat to the feed from other process streams. A conventional jacket is preferably provided for startup purposes only and uses 150 psig steam when heating is necessary. The working liquid volume provides approximately 10 minutes of residence time. The dimensions were chosen for maximizing agitator performance.

Extraction Columns

There are two liquid-liquid extraction columns in the invention process. These are the Sulfox Extraction Column (119) and the Raffinate Wash Column (122).

The Sulfox Extraction Column (119) is a countercurrent packed bed liquid-liquid contactor. The column is equipped with structured packing.

The Raffinate Wash Column (122) is a countercurrent mechanically agitated liquid-liquid contactor. During the same testing program, the trials utilizing a packed bed extractor in this application revealed poor dispersion of the phases. Additional energy input was necessary to overcome the high interfacial surface tension between the two liquid phases. As stated earlier, the solvent to feed ratio in this column is very low. This low solvent to feed ratio also decreases the mass transfer efficiency. The commercial column was scaled from the pilot tests based on the hydraulic capacity needed for the larger throughput. The commercial column contains 36 agitated stages. The heavy phase is dispersed, while the light phase is continuous.

Utilizing a mechanically agitated contactor for the Raffinate Wash Column (122) is a very expensive option. In addition, this apparatus is generally speaking unattractive to operating personnel due its mechanical nature and probable need for intensive maintenance. There are potential process improvements aimed at replacing this apparatus with a less expensive type without moving parts (FIG. 8).

Distillation Columns

There are three distillation columns in the invention process. These are the Solvent Purification Column (139), the Solvent Recovery Column (149), and the Hydrocarbon Recovery Column (152). In all three cases, conventional packed columns were utilized.

The Solvent Purification Column (139) is relatively large with an estimated height of 82 feet (tangent to tangent) and a diameter of 7 feet. The separation is difficult due to the low relative volatility between water and acetic acid. A total of 38 theoretical stages are necessary to complete the separation. High efficiency packing is utilized to minimize the column height. The column operates slightly above atmospheric pressure at 17 psia The column includes three packed sections so that the optimum feed location is used for the various streams entering the column.

The Solvent Recovery Column (149) is relatively small with an estimated height of 25 feet (tangent to tangent) and a diameter of 18 inches. The separation of AA from extract is relatively easy. A total of 8 theoretical stages are necessary to complete the separation. Standard packing is utilized to minimize cost. The column operates slightly above atmospheric pressure at 18 psia.

The Hydrocarbon Recovery Column (152) is relatively short with an estimated height of 28 feet (tangent to tangent) but has a relatively large diameter at 7 feet. The separation of hydrocarbons from sulfones is relatively easy. However, the column operates at a pressure of about 0.19 psia, which creates considerable volumetric vapor traffic. A total of 8 theoretical stages are necessary to complete the separation. Standard packing is utilized to minimize cost.

Liquid-Liquid Decanters

There are three decanters in the invention process. These are the First Stage Oxidizer Oil Decanter (101), the Second Stage Oxidizer Oil Decanter (106), and the Solvent Purification Column Reflux Decanter (142).

Conventional horizontal gravity separators with internal baffles are utilized. Generally speaking, the materials being separated have a low viscosity (<2 cP) and the density ratio between the heavy phases and light phases are approximately 1.2. Therefore, separations are relatively easy. Conservative methods were utilized for sizing, and therefore, a reduction in the dimensions of these decanters is definitely possible.

Efficient separation in the Second Stage Oxidizer Oil Decanter (106) is preferred since carryover of heavy phase to the Destruct Reactor (112) would compromise its 316 SS materials of construction.

Vapor-Liquid Separators

There are two primary vapor-liquid separators in the invention process. These are the Water Flash Vessel (108A), the Solvent Flash Vessel (136). The Water Flash Vessel (108A) and the Solvent Flash Vessel (136) are conventional vertical separators with mist eliminators. Generally speaking, the vapor-liquid separation in these vessels is relatively easy. Efficient separation in the Water Flash Vessel (108A) is preferred since carryover of the liquid phase to the Solvent Purification Column (139) would compromise its 316 SS materials of construction.

Adsorption Columns

There are two adsorption columns in the invention process. These are the Raffinate Polishing Columns (126 and 129). The columns are identical with an estimated height of 42 feet (tangent to tangent) and a diameter of 5 feet. Each column contains two 15-foot beds of refiner's clay; however, other adsorbent material may be possible. Both columns are used for polishing the gas oil by removing small amounts of sulfur-containing compounds and small amounts of acetic acid.

Heat Exchangers

There are a total of 25 heat exchangers in the invention process. Shell and Tube exchangers are utilized in all cases. Generally speaking, a horizontal orientation was used for condensing applications and a vertical orientation was used for vaporizing applications.

There are five traditional reboilers. The Water Flash Vessel Reboiler (109A), the Solvent Flash Vessel Reboiler (138), and the Solvent Purification Column Trim Reboiler (143) are thermosiphons. The Solvent Recovery Column Reboiler (150) utilizes forced circulation since bubble point variation along the boiling path is large. The Hydrocarbon Recovery Column Reboiler (154) is based on falling film technology to minimize the hot wall contact time for the concentrated sulfone stream.

The Solvent Flash Vessel Overhead Condenser (137) has a dual function. The exchanger is used to condense vapors from the Solvent Flash Vessel while vaporizing liquid from the Solvent Purification Column. A vertical orientation is utilized with the vaporization on the tube side and the condensation on the shell side. Forced circulation is utilized on the vaporizing tube side to allow gravity flow liquid return to the Solvent Flash Vessel Distillate Receiver for the condensing shell side. Where present, non-condensable gases were considered in the design of condensers.

Potential Oxidation System Improvement

The oxidation system described above comprises the following concepts: (1) two stage addition of oxidant—this assures that the lowest concentrations of unoxidized sulfur compounds are in contact with the highest concentrations of oxidant; (2) Water Removal between Oxidation Stages—this allows recycle of the heavy phase leaving the second Stage Oxidation to the First Stage Oxidation without substantial loss of oxidant. This also eliminates any water dilution affects on the fresh oxidant added to the second Stage Oxidation, and therefore, promotes maximum mass transfer of oxidant from the heavy phase to the light phase; and (3) second Stage Oxidation at reduced temperature—this serves to minimize unwanted side reactions in the second Stage Oxidation, and therefore, preserves the oxidant for recycle to the First Stage Oxidation.

Based on these concepts and the simulated commercial process shown in FIGS. 3-8 and described above, and extensive laboratory experimentation showed that the proposed reactor and process will be capable of consistently producing gas oil comprising a sulfur content less than 10 ppm by weight.

However, it is believed that improvements may be possible. For example, it should be noted that the residence time required for oxidation in the first stage is relatively short. Conversions greater than 98 percent were obtained in less than 5 to 10 minutes. However, experimental data indicated that a relatively long residence time would be required in the second Stage Oxidation. Long residence time in the second Stage Oxidation would result in a large expensive reactor. In addition, a long residence time would also cause excessive depletion of oxidant via side reactions in the heavy phase.

Based on measurements of the active oxygen concentration in the light phase during the second Stage Oxidation, it became apparent that the reaction mechanism at low concentrations of unoxidized sulfur compounds is kinetically controlled rather than mass transfer controlled. In addition, it was discovered that the solubility of PAA in the light phase is great enough to provide a stoichiometric excess for completing the oxidation.

With this information in mind, a revised oxidation concept was developed, in which a pictorial depiction is shown in FIG. 8 and is described as follows.

Improved Oxidation Scheme—Part 1 (FIG. 8)

A two-stage oxidation with water removal between stages and a lower second stage oxidation temperature is still employed. However, in this revised scheme, the Second Stage Oxidizer is a single liquid phase plug flow reactor (104B). Mass transfer of the oxidant to the light phase is accomplished in a short residence time static mixer placed immediately up-stream of the single liquid phase plug flow reactor. A residence time of one to two minutes is sufficient to transfer sufficient oxidant from the heavy phase into the light phase. The lower portion of the plug flow reactor is used to separate the two phases via gravity settling. The heavy phase is immediately recycled to the First Stage Oxidizer. Immediate removal of the heavy phase minimizes the extent of side reactions, and therefore, maximizes the amount of recycle oxidant. The isolated light phase flows through the plug flow reactor, where residence times can be made arbitrarily long without an excessive cost impact.

Since the residence time in the Second Stage Oxidizer is shorter than the time required for sufficient in situ conversion of hydrogen peroxide to PAA, a continuously stirred tank reactor (CSTR) is added to the oxidation system. The PAA Reactor (171) is used to pre-form the PAA from fresh 70 wt % hydrogen peroxide and recycle acetic acid. The fresh catalyst necessary to replace the sulfuric acid purged from the oxidation system via Water Flash Vessel (108B) is introduced through the PAA Reactor (171). Although a CSTR was chosen for the application, it is technically feasible to utilize a simple plug flow reactor instead. The CSTR is expected to cost more than the plug flow reactor, but it does offer an easier mode of operation, especially with respect to startup of the oxidation system.

Based on the short residence time requirements for the First Stage Oxidation, the relatively expensive, high maintenance, mechanically agitated (e.g., 100A, FIG. 3) is replaced with a plug flow pipe reactor equipped with an internal static mixer. This is expected to reduce capital costs and maintenance costs.

A pilot reactor system was employed to conduct a continuous flow pilot testing that serves as the basis for the revised oxidation concept and commercial extension described above. The results of this pilot testing, although not optimized, indicate that the oxidation system can consistently produce gas oil with less than 25 ppmw of unoxidized sulfur compounds.

Improved Oxidation Scheme—Part 2

To obtain gas oil with less than 10 $ppm_w$ of unoxidized sulfur compounds, it is proposed that a three-stage oxidation system be used.

The residence time in the Second Stage Oxidizer shown in FIG. 8 would be divided appropriately into two reactors. Each of these reactors would be equipped with a mixing zone at the inlet, followed by a separation zone where the heavy phase would be removed. Finally, each of these reactors would have a single liquid phase pipe flow segment where the sulfur containing compounds in the light phase continue to be oxidized.

The gas oil would flow through these two reactors in series. The fresh PAA solution from the Peracetic Acid Reactor (171) would be split into two parallel streams. Each of these two PAA streams would be fed to the inlet mixing sections of a Second Stage Oxidizer and a third Stage Oxidizer. The heavy phase from the settling zone of each of these reactors would be recycled to the First Stage Oxidizer.

Other Process Improvements

In the process described thus far, the spent acetic acid used to regenerate the Raffinate Polishing Columns is sent to the Solvent Recovery and Solvent Purification System (FIG. 6) Purification Column (139). This spent acetic acid contains sulfone compounds and possibly small amounts of unoxidized sulfuric compounds. A more energy efficient approach is to recycle the spent acetic acid directly to the beginning of the process in order to partially saturate the gas oil feed. This reduces the heat load requirements for the Solvent Flash Vessel (136) by approximately 10 percent. In addition, if the spent acetic acid from the Raffinate Polishing Columns (126 and 129) comprise unoxidized sulfur compounds, recycling this stream to the oxidation system would increase conversion and eliminate a potential buildup of these materials in this recycle loop.

It is possible to add an extraction column to the oxidation system where heavy phase from the discharge of the First Stage Oxidizer Oil Decanter (101B) is contacted with fresh gas oil. Acetic acid in the heavy phase will be extracted into the gas oil. This reduces the amount of acetic acid that must be vaporized in the Water Flash Vessel (108B), thereby reducing steam consumption. In addition, the amount of acetic acid processed through the Solvent Purification Column (139) will be reduced. An added benefit could be the recovery of a portion of the unreacted peracetic acid leaving the First Stage Oxidizer.

In the simulated design, crude solvent from the Solvent Flash Vessel (136) is used to saturate the fresh gas oil feed. This crude solvent contains a substantial amount (about 4.4 wt %) of aromatic hydrocarbons. These aromatic hydrocarbons are susceptible to chemical attack by the oxidant, and therefore, could cause additional oxidant and gas oil losses. The acetic acid from the bottom of the Solvent Purification Column (139) has a lower aromatic content (about 1.1 wt %). Therefore, it is possible to use the acetic acid from the bottom of the Solvent Purification Column to saturate the fresh gas oil feed, and it is possible to use all the crude acetic acid from the Solvent Flash Vessel (136) for feeding the Sulfox Extraction Column (119).

An additional improvement may be possible by replacing the stream jet system of the Hydrocarbon Recovery Column (152) with a liquid ring vacuum pump for the Hydrocarbon Recovery Column (152). If fresh gas oil can be used as the vacuum pump cooling fluid, it may be possible to reduce the refrigeration requirements for an alternative Chiller System and simultaneously reduce the loses of acetic acid. Instead of utilizing 0° F. (−17.8° C.) −10° F. (−12.2° C.) brine, 40° F. (4.4° C.) chilled water may be possible. In the best case, a Chiller System and the Hydrocarbon Column Vent Condenser (156) would be eliminated entirely. It is hoped that the gas oil absorbs the acetic acid from the vent stream. Once this acetic acid is absorbed, it can then be feed to the front of the process and recovered. The maximum possible acetic acid recovery is 12.0 lb/hr, which is worth about 0.028 USD per bbl of product. In addition, steam consumption and wastewater production is reduced. However, additional electricity may be necessary.

A mechanically agitated contactor is utilized for the Raffinate Wash Column (122) in the simulated process described above. The mechanically agitated contactor is expensive and will probably require substantial maintenance. Therefore, it is possible to replace the mechanically agitated contactor with a series of mixer/settlers. This should reduce capital requirements. With mixer/settlers, it may also be possible to decrease the wash water requirements.

If unoxidized thiophenes co-distill in the Hydrocarbon Recovery Column (152), the recycle distillate should be sent to the oxidation system rather than the Raffinate Wash Column (122).

One may consider adding a feed vaporizer to the Solvent Flash Vessel (136) due to large difference in bubble points between feed and bottoms liquid.

It may be possible to delete the Solvent Recovery Column Reflux Drum (147) and reflux the top of the Solvent Recovery Column (149) directly from the Solvent Recovery Column Overhead Condenser (146). A hydraulic study is necessary to determine the feasibility of this cost savings idea. It may also be possible to delete 148.

It may be possible to delete the Destruct Reactor (112). During the continuous flow pilot testing, the oxidant level leaving the second Stage Oxidation was monitored. The concentration of active oxidant was very low. If the Destruct Reactor (112) is removed, most of the active oxygen remaining in the gas oil should be removed in the Sulfox Extraction Column (119) by the acetic acid extraction solvent. The solvent stream leaving the Sulfox Extraction Column (119) flows to the Solvent Flash Vessel (136) where the high temperature will certainly destroy any remaining active oxygen. However, prior to deleting the Destruct Reactor (112), a complete safety study is necessary.

One may consider adding steam to the bottom of the Hydrocarbon Recovery Column (152). This could allow a higher operating pressure and/or increased recovery of hydrocarbon.

There are currently five heat exchangers that cool process liquids with cooling water. These are: 118 (3.331 mmbtu/hr (3.514 MJ/hr)), 120 (1.216 mmbtu/hr (1.283 MJ/hr)), 145 (0.368 mmbtu/hr (0.3882 MJ/hr)), 155 (0.819 mmbtu/hr (0.864 MJ/hr)), and a solvent hold tank cooler (0.857 mmbtu/hr (0.9041 MJ/hr)). The heat duties for these five exchangers sum to a total load of 6.6 mmbtu/hr (6.963 MJ/hr). This is worth approximately 0.21 usd/bbl of feed or 0.23 usd/bbl of product. It may be desirable to utilize additional process/process interchanger, in order to recover some of the wasted energy.

The Solvent Purification Column Overhead Condenser (141) has a heat duty of 26.6 mmbtu/hr (28.063 MJ/hr). It may be possible to recover a large portion of this energy by increasing the operating pressure of the Solvent Purification Column (139). However, increasing this pressure would either increase the size of the Solvent Flash Vessel Reboiler (138) or increase the steam pressure requirements for this exchanger.

Potential Advantages

Based on the disclosure contained herein, it should be apparent that potential advantages include:

(1) Two Stage Addition of Oxidant—This assures that the lowest concentrations of unoxidized sulfur compounds are in contact with the highest concentrations of oxidant.

(2) Water Removal between Oxidation Stages—This allows recycle of the heavy phase leaving the second stage oxidation to the first stage oxidation without loss of oxidant. This also eliminates any water dilution affects on the fresh oxidant added to the second stage oxidation, and therefore, promotes maximum mass transfer of oxidant from the heavy phase to the light phase.

(3) Second Stage Oxidation at Reduced Temperature—This minimizes the unwanted side reactions in the second stage oxidation, and therefore, preserves the oxidant for recycle to the first stage oxidation.

Based on these concepts and the simulated process shown in FIGS. 3-7, extensive laboratory experimentation proved the viability and repeatability of these oxidation concepts. The experiments consistently produced gas oil with a sulfur content less than 10 ppm by weight.

It also became apparent that the residence time required for oxidation in the first stage is relatively short. Conversions greater than 98 percent were obtained in less than 5 to 10 minutes. However, the experimental data also indicated that a relatively long residence time is required in the second stage oxidation. Long residence time in the second stage oxidation results in a large expensive reactor. In addition, this long residence time also causes excessive depletion of oxidant via side reactions in the heavy phase.

Based on measurements of the active oxygen concentration in the light phase during the second stage oxidation, it became apparent that the reaction mechanism at low concentrations of unoxidized sulfur compounds is kinetically controlled rather than mass transfer controlled. In addition, it was discovered that the solubility of PAA in the light phase is great enough to provide a stoichiometric excess for completing the oxidation.

With this information, an improved oxidation scheme is disclosed herein (FIG. 8).

A two-stage oxidation with water removal between stages and a lower second stage oxidation temperature is still employed. However, in this revised scheme, the Second Stage Oxidizer is a single liquid phase plug flow reactor. Mass transfer of the oxidant to the light phase is accomplished in a short residence time static mixer placed immediately upstream of the single liquid phase plug flow reactor. A residence time of one to two minutes is sufficient to transfer sufficient oxidant from the heavy phase into the light phase. The lower portion of the plug flow reactor is used to separate the two phases via gravity settling. The heavy phase is immediately recycled to the First Stage Oxidizer. Immediate removal of the heavy phase minimizes the extent of side reactions, and therefore, maximizes the amount of recycle oxidant. The isolated light phase flows through the plug flow reactor, where residence times can be made arbitrarily long without an excessive cost impact.

Since the residence time in the Second Stage Oxidizer is shorter than the time required for sufficient in situ conversion of hydrogen peroxide to peracetic acid, a continuously stirred tank reactor (CSTR) is added to the oxidation system. The PAA Reactor (171) is used to pre-form the PAA from fresh 70 wt % hydrogen peroxide and recycle acetic acid. The fresh catalyst necessary to replace the sulfuric acid purged from the oxidation system via Water Flash Vessel (108A) is introduced through the PAA Reactor. Although a CSTR was chosen for the application, it is technically feasible to utilize a simple plug flow reactor instead. The CSTR is expected to cost more than the plug flow reactor, but it does offer an easier mode of operation, especially with respect to startup of the oxidation system.

Based on the short residence time requirements for the first stage oxidation, the relatively expensive, high maintenance mechanically agitated contactor is replaced with a plug flow pipe reactor equipped with an internal static mixer. This is expected to reduce capital costs and maintenance costs.

The continuous flow pilot testing results indicate that the oxidation system in the invention process can consistently produce gas oil with less than 25 ppm by weight of unoxidized sulfur compounds; although, it is possible to achieve a gas oil with a lower sulfur content.

Obviously, numerous modifications and variations on the present invention are possible in light of the above teachings. It is therefore to be understood that within the scope of the appended claims, the invention may be practiced otherwise than as specifically described herein.

What is claimed as new and is intended to be secured by the Letters Patent is:

1. A process for reducing the concentration of organosulfur compounds in a hydrocarbon-based fluid, comprising contacting said hydrocarbon-based fluid with a first oxidant in a first reactor to obtain a first reactor effluent and contacting a second liquid comprising at least one hydrocarbon with a second oxidant in a second reactor to obtain a second reactor effluent, wherein a) said second liquid comprises said first reactor effluent or is obtained from said first reactor effluent by phase separation as a first light phase, b) said first and second oxidant comprise a peroxycarboxylic acid obtained by reacting a carboxylic acid with hydrogen peroxide and c) said hydrocarbon fluid has a concentration of unoxidized organosulfur compounds that is greater than the concentration of unoxidized organosulfur compounds in said second liquid.

2. The process of claim 1, wherein the ratio of the total oxidant concentration in the first oxidant to the total oxidant concentration in the second oxidant is less than or equal to 1.

3. The process of claim 1, wherein said second liquid is obtained from said first reactor effluent by phase separation as a first light phase.

4. The process of claim 3, wherein said first oxidant is obtained from said second reactor effluent by phase separation as a second heavy phase.

5. The process of claim 1, which further comprises contacting a third liquid, obtained from said second reactor effluent by phase separation as a second light phase, with a third oxidant in a third reactor.

6. The process of claim 1, wherein the hydrocarbon-based fluid is a middle distillate distilling from about 65.6° C. to about 385° C.

7. The process of claim 6, wherein a fuel containing oxidized sulfur compounds obtained from said second reactor effluent by phase separation as a second light phase is extracted in an extraction step with the carboxylic acid used to form the peroxycarboxylic acid to obtain a first raffinate and a first extract, said first raffinate is contacted in a raffinate wash step with an aqueous solution to obtain a washed raffinate and an aqueous extract and said washed raffinate is contacted with an adsorbent material to obtain a product fuel.

8. The process of claim 7, wherein said extraction step is carried out in an extraction column.

9. The process of claim 7, wherein said raffinate wash step is carried out in a raffinate wash column.

10. The process of claim 7, wherein said first extract is separated in a solvent recovery step into a recovered carboxylic acid and an extract depleted of carboxylic acid and part of the recovered carboxylic acid is recycled to the extraction step.

11. The process of claim 10, wherein the extract depleted of carboxylic acid is distilled in a hydrocarbon recovery step to obtain a recovered hydrocarbon and an extract byproduct.

12. The process of claim 11, wherein the extract depleted of carboxylic acid is distilled at a pressure of less than 1 bar.

13. The process of claim 11, wherein the recovered hydrocarbon is combined with the first raffinate obtained in the extraction step.

14. The process of claim 11, wherein the recovered hydrocarbon is combined with the hydrocarbon-based fluid that is fed to the first reactor.

15. The process of claim 1, wherein said peroxycarboxylic acid is peroxyacetic acid and said carboxylic acid is acetic acid.

16. The process of claim 15, further comprising a step of reacting acetic acid with hydrogen peroxide to form peroxyacetic acid in an additional reactor and feeding the resulting mixture to said second reactor.

* * * * *